US007757322B2

(12) United States Patent
An

(10) Patent No.: US 7,757,322 B2
(45) Date of Patent: Jul. 20, 2010

(54) MATTRESS

(76) Inventor: Jung Ho An, 227-4, Jangpyeong-ri, Daewol-myeon, Icheon-si, Gyeonggi-do 467-853 (KR)

( * ) Notice: Subject to any disclaimer, the term of this patent is extended or adjusted under 35 U.S.C. 154(b) by 0 days.

(21) Appl. No.: 12/287,171

(22) Filed: Oct. 7, 2008

(65) Prior Publication Data

US 2009/0100606 A1 Apr. 23, 2009

(30) Foreign Application Priority Data

Oct. 9, 2007 (KR) ..... 10-2007-0101660
Oct. 24, 2007 (KR) ..... 10-2007-0107409
Dec. 31, 2007 (KR) ..... 10-2007-0141824

(51) Int. Cl.
*A47C 27/15* (2006.01)
*A47C 27/20* (2006.01)

(52) U.S. Cl. ..... 5/722; 5/727; 5/738; 5/740

(58) Field of Classification Search ..... 5/716, 5/717, 722, 723, 727, 737, 738, 739, 740
See application file for complete search history.

(56) References Cited

U.S. PATENT DOCUMENTS 1,528,066 A * 3/1925 Mcentire ..... 5/722
5,642,546 A * 7/1997 Shoenhair ..... 5/680
5,819,349 A * 10/1998 Schwartz ..... 5/740
5,960,496 A * 10/1999 Boyd ..... 5/722
5,970,547 A * 10/1999 Cavazos ..... 5/690
6,055,689 A * 5/2000 Cavazos ..... 5/690
6,122,787 A * 9/2000 Kao ..... 5/723
6,256,821 B1 * 7/2001 Boyd ..... 5/722
6,370,717 B1 * 4/2002 Kao ..... 5/723
7,493,668 B2 * 2/2009 Piraino ..... 5/738
2004/0172767 A1 9/2004 Mossbeck et al.

FOREIGN PATENT DOCUMENTS

| | | |
|---|---|---|
| CA | 2290244 | 5/2000 |
| JP | 2000-308547 | 11/2000 |
| KR | 20-0298276 | 12/2002 |
| KR | 20-0337232 | 12/2003 |
| WO | WO 2005/002400 | 1/2005 |
| WO | WO 2005/099520 | 10/2005 |

OTHER PUBLICATIONS

International Search Report for corresponding PCT application PCT/KR2008/001709.

* cited by examiner

*Primary Examiner*—Michael Trettel
(74) *Attorney, Agent, or Firm*—Dilworth & Barrese, LLP.

(57) ABSTRACT

A bed mattress is provided for employing a plurality of cushion elements to be arranged in different portions of the mattress divided corresponding to the user's body parts and have appropriate elasticity for the corresponding part of the user's body, which comprises a mattress frame with an enclosing wall of elastic material for providing a mounting space therein; a plurality of cushion elements disposed in the mounting space and forming a mattress body together with the mattress frame; a side pad covering the periphery of the mattress body; and upper and lower cover pads with outer edges fastened respectively to the top and bottom edges of the side pad to enclose the upper and lower surfaces of the mattress body.

28 Claims, 23 Drawing Sheets

【Figure 1】
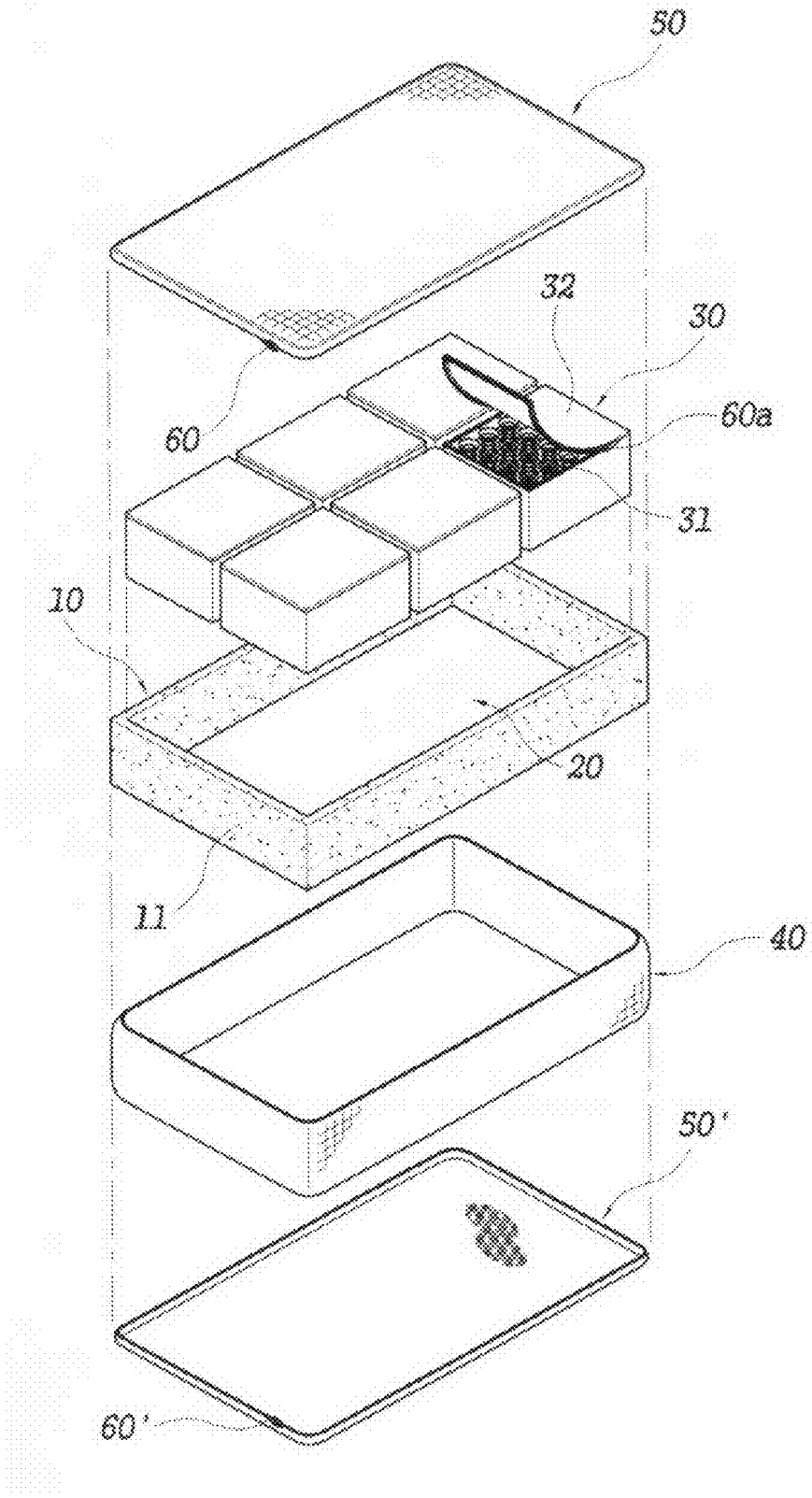

【Figure 2】
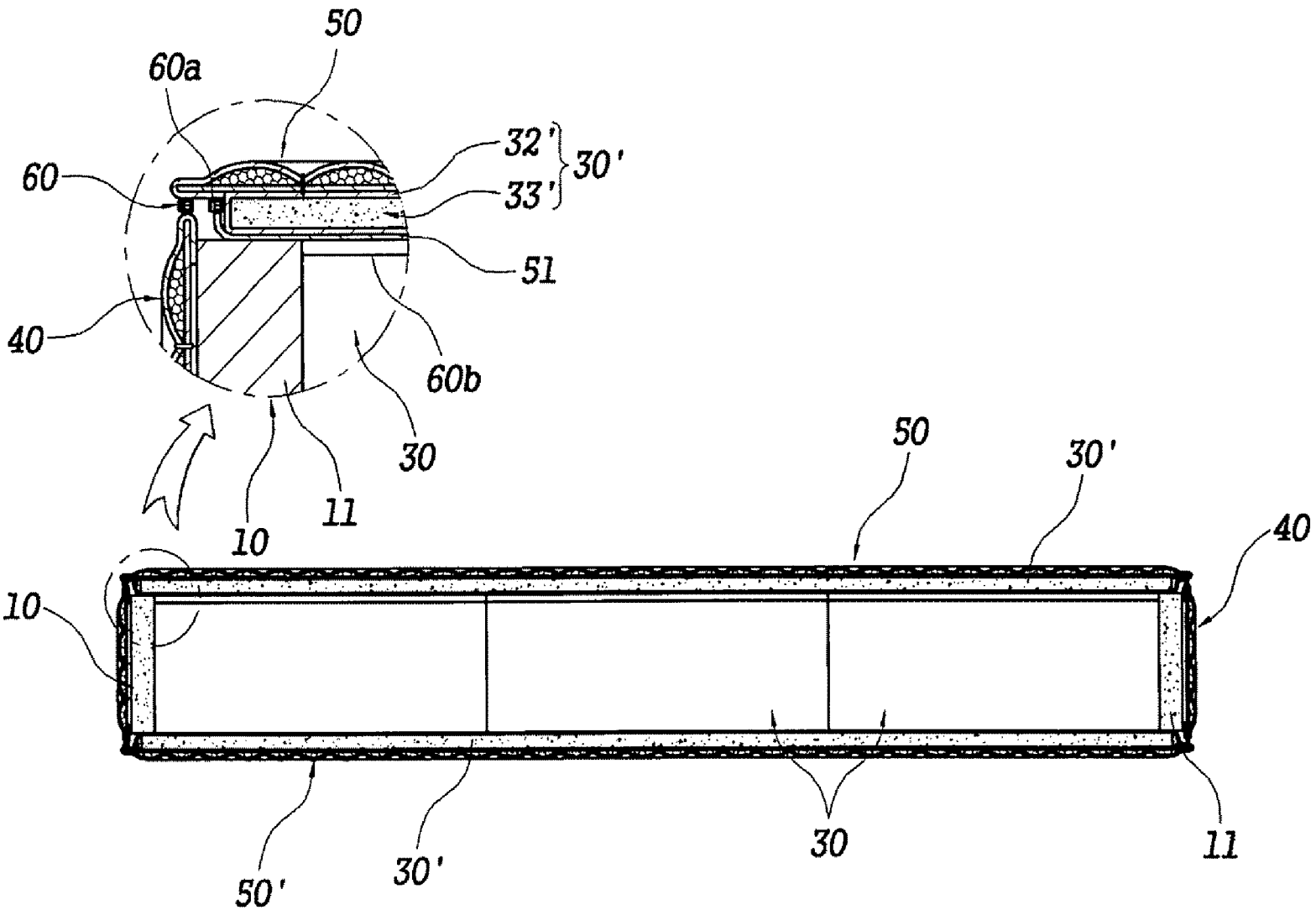

【Figure 3】
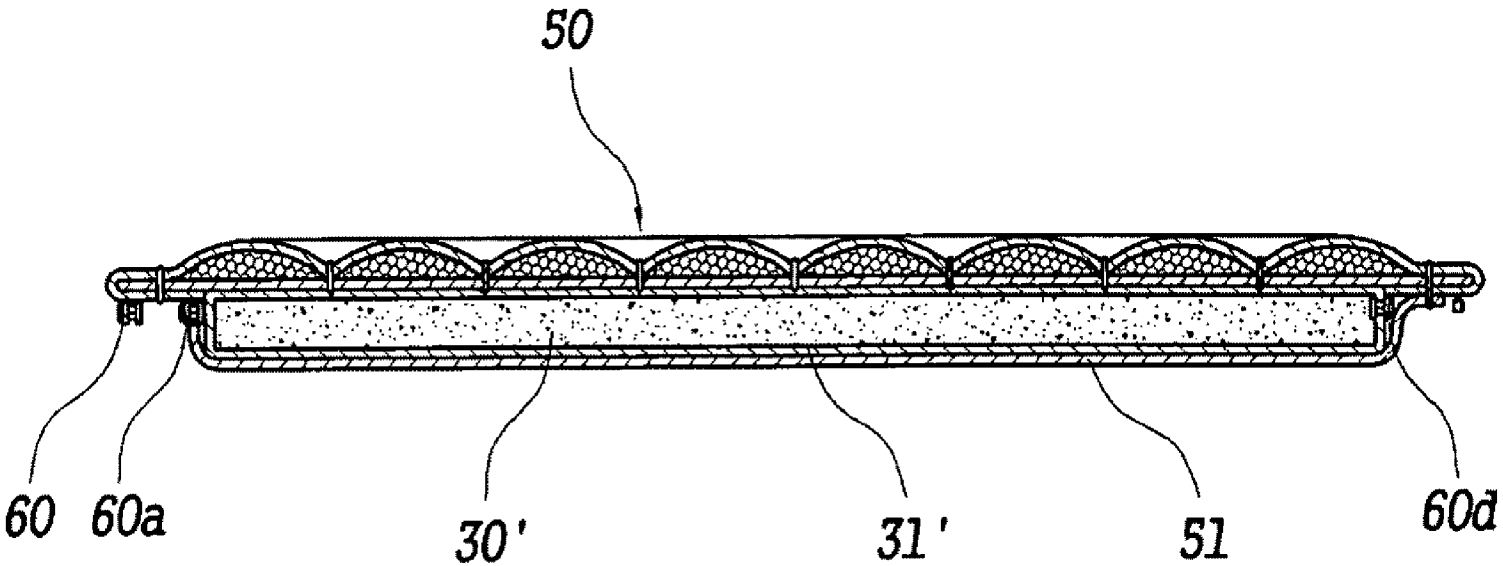

【Figure 4】
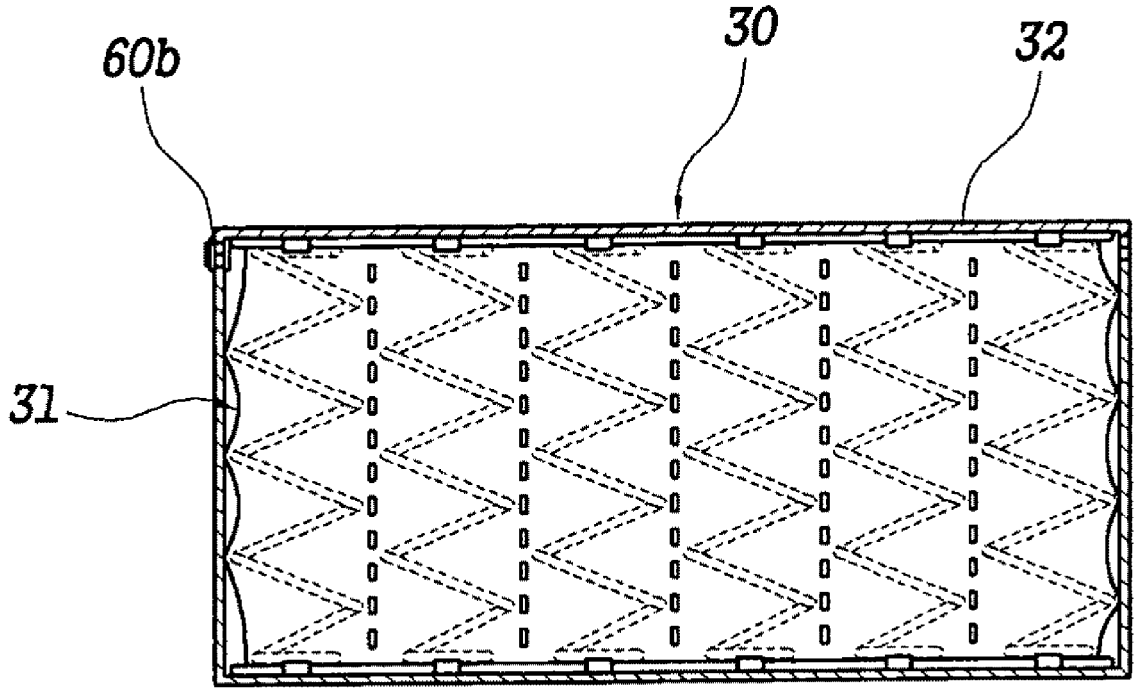

【Figure 5】
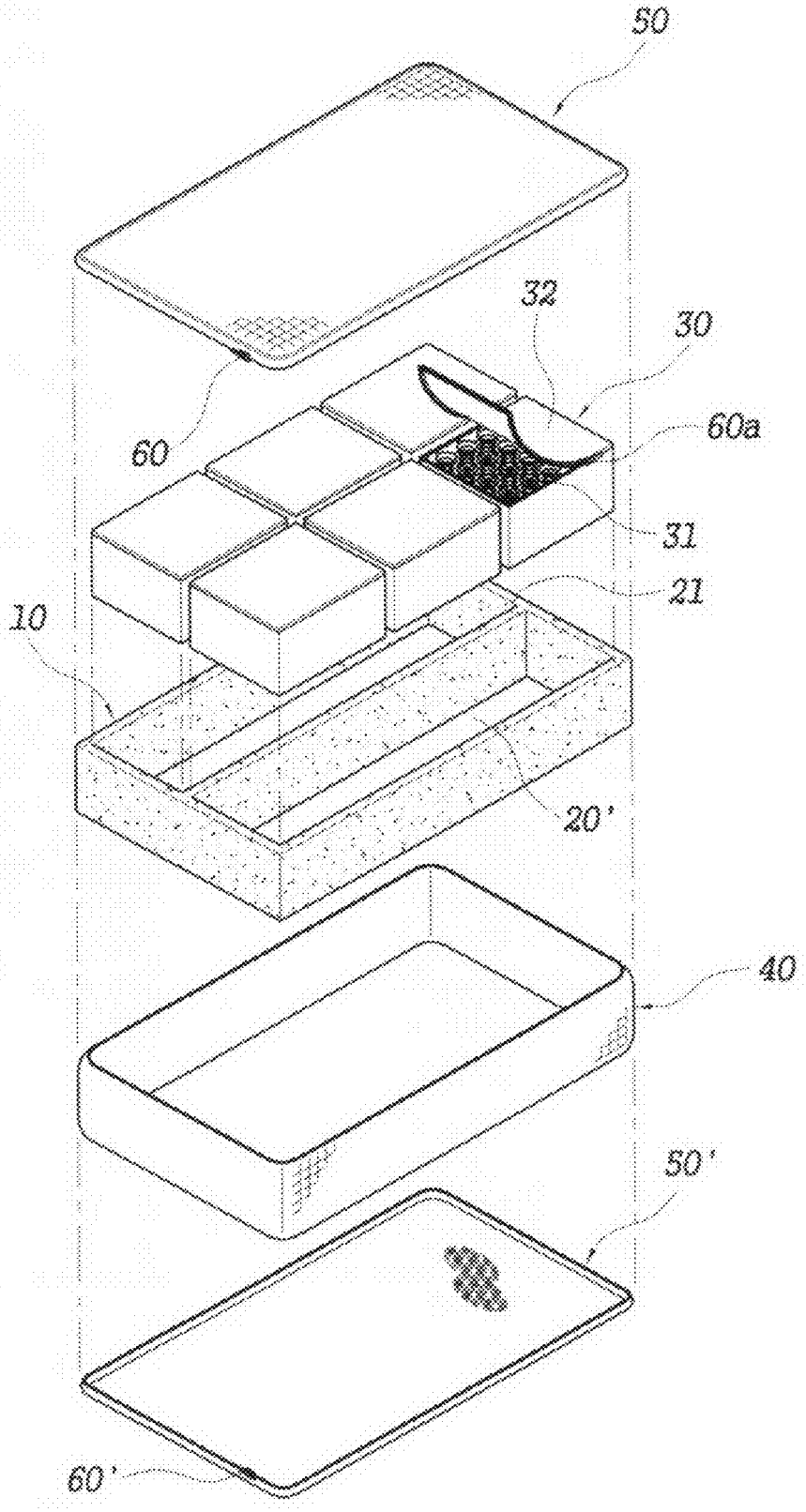

【Figure 6】
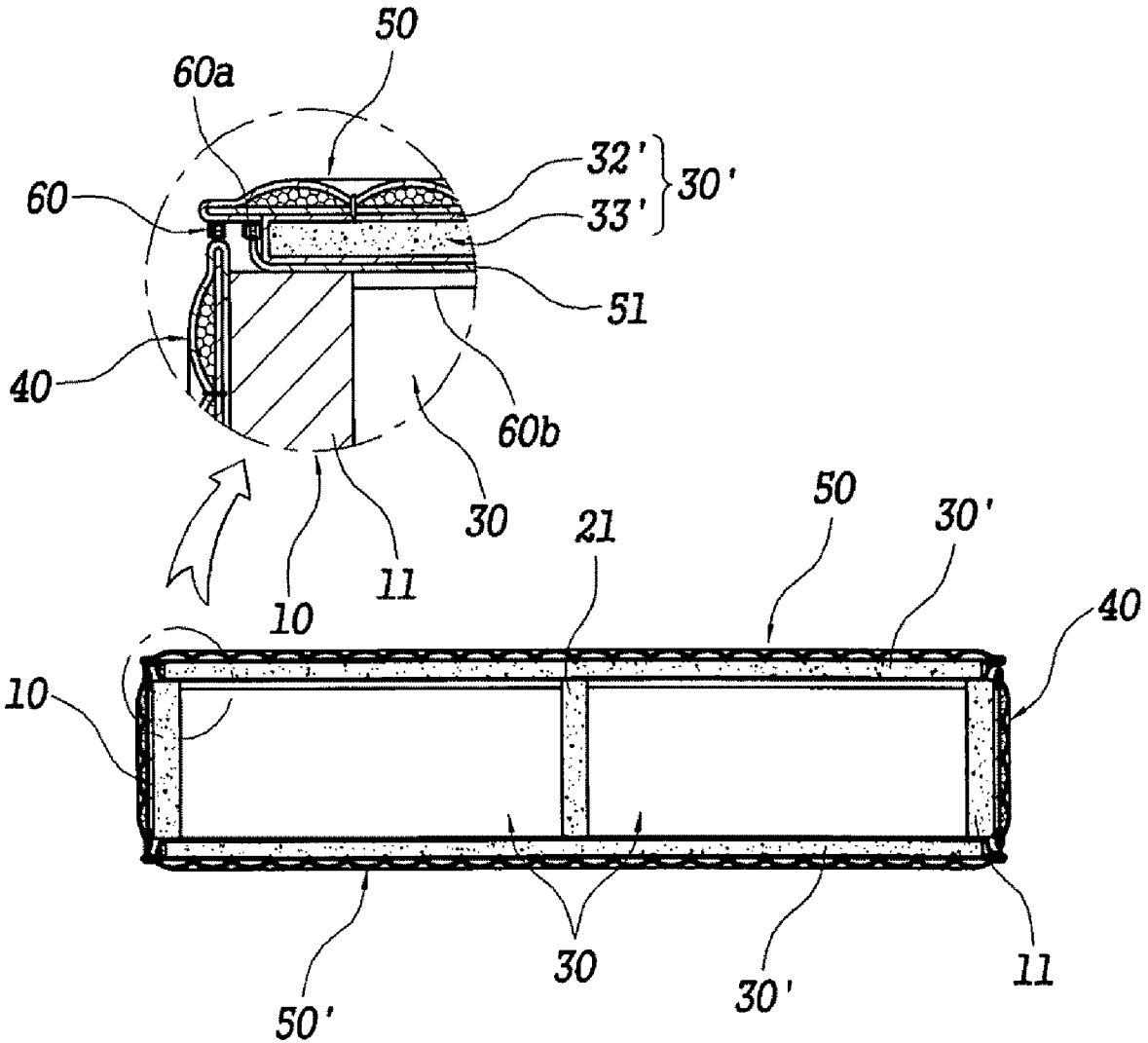

【Figure 7】
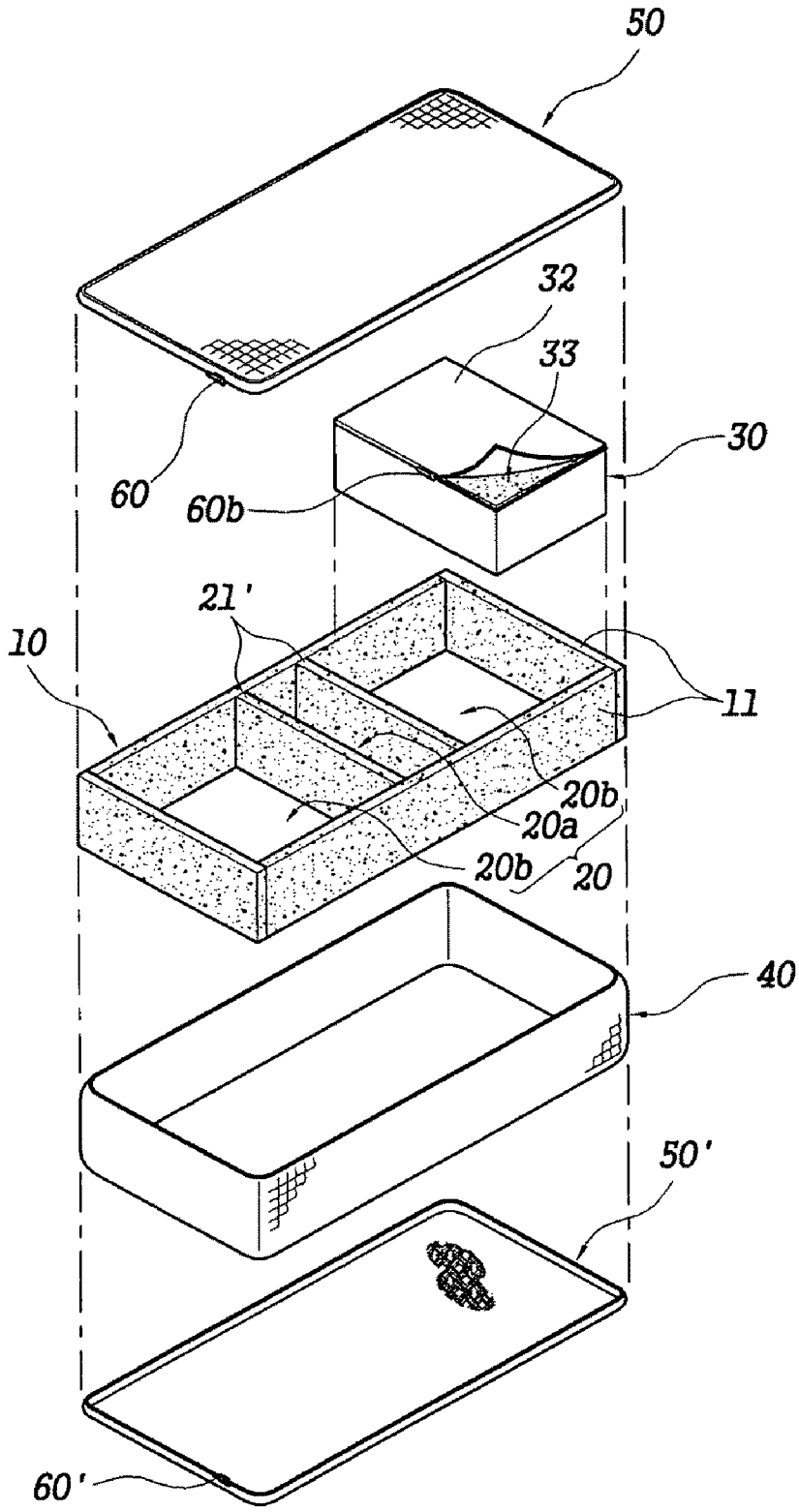

【Figure 8】
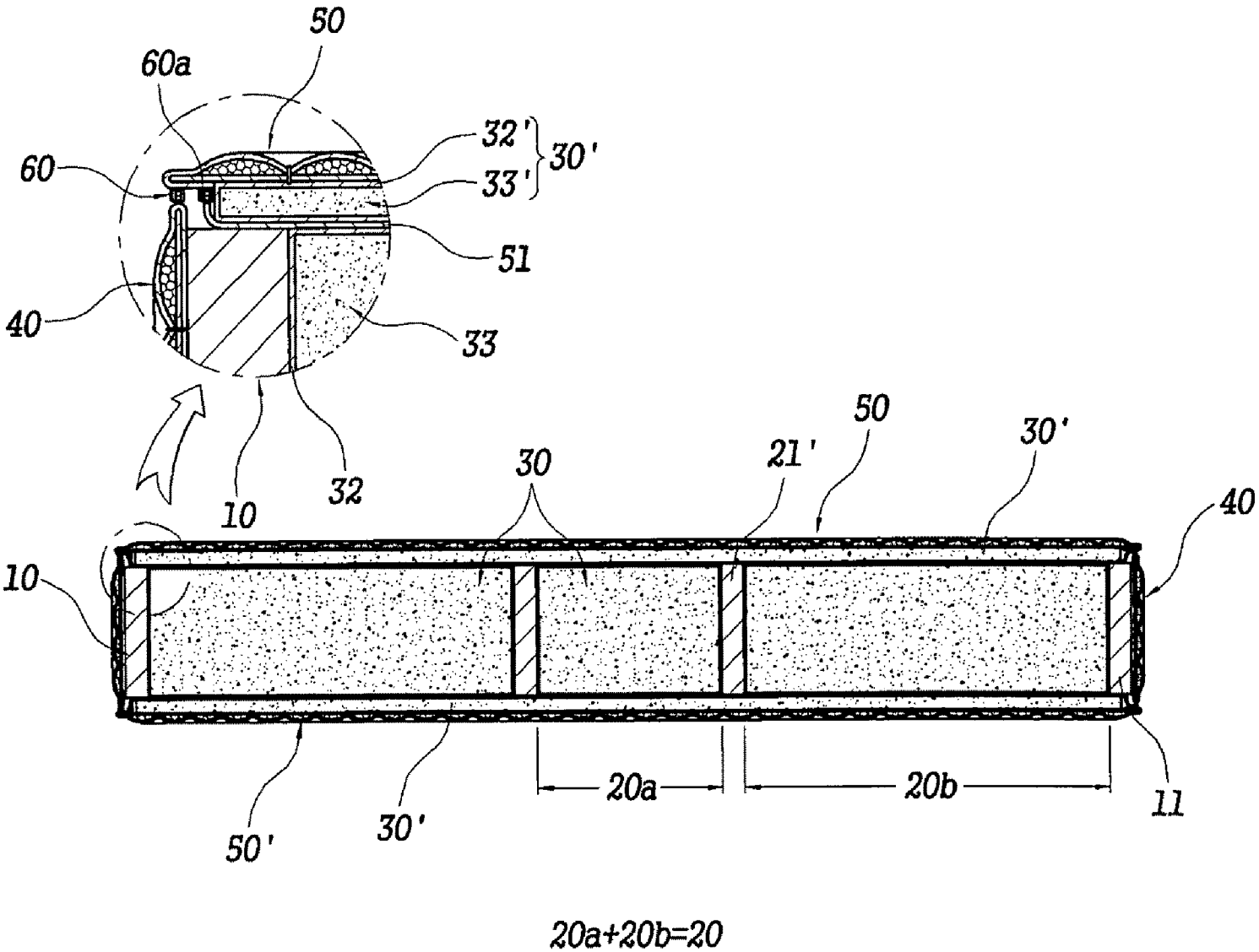

【Figure 9】
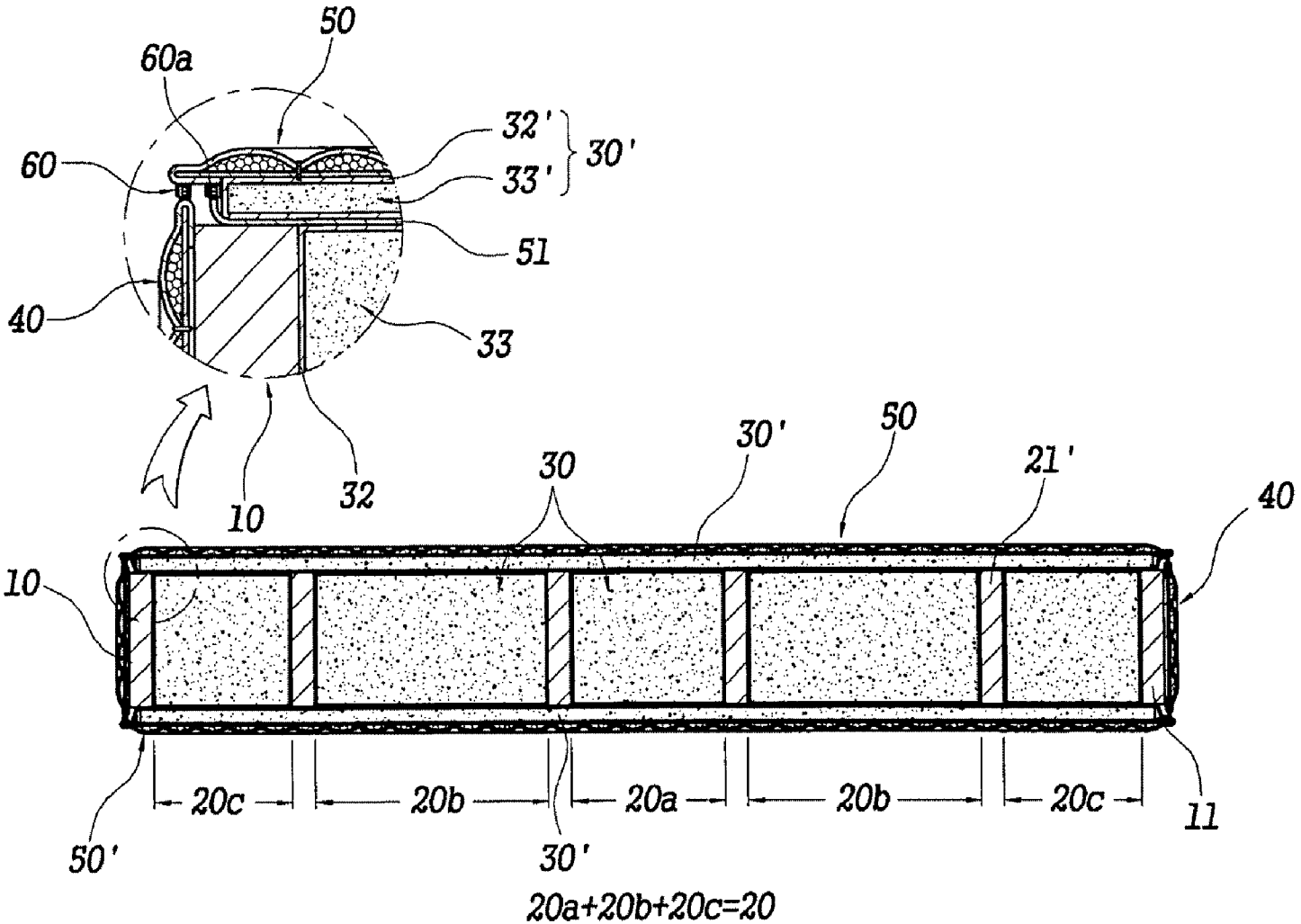

【Figure 10】
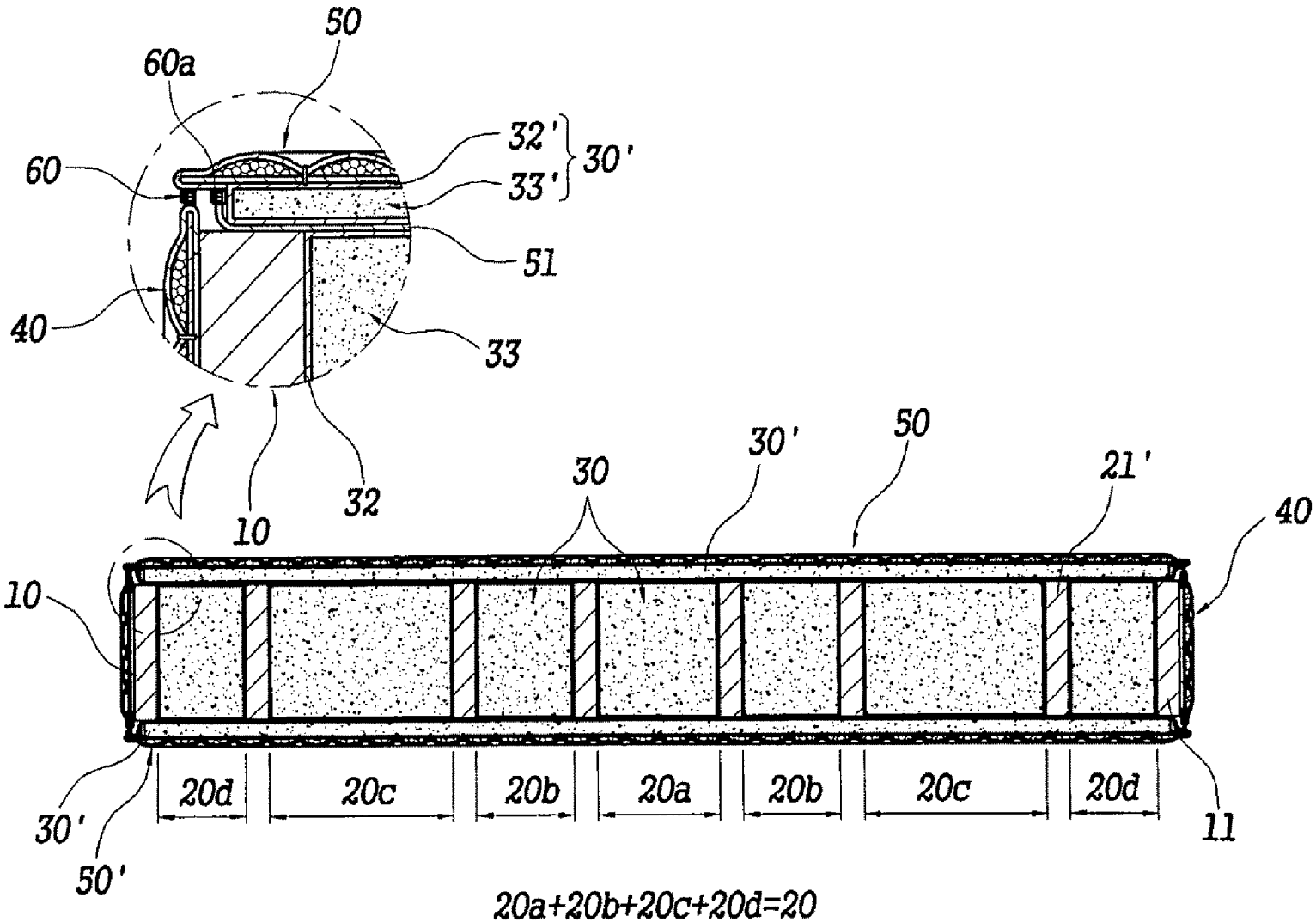

【Figure 11】
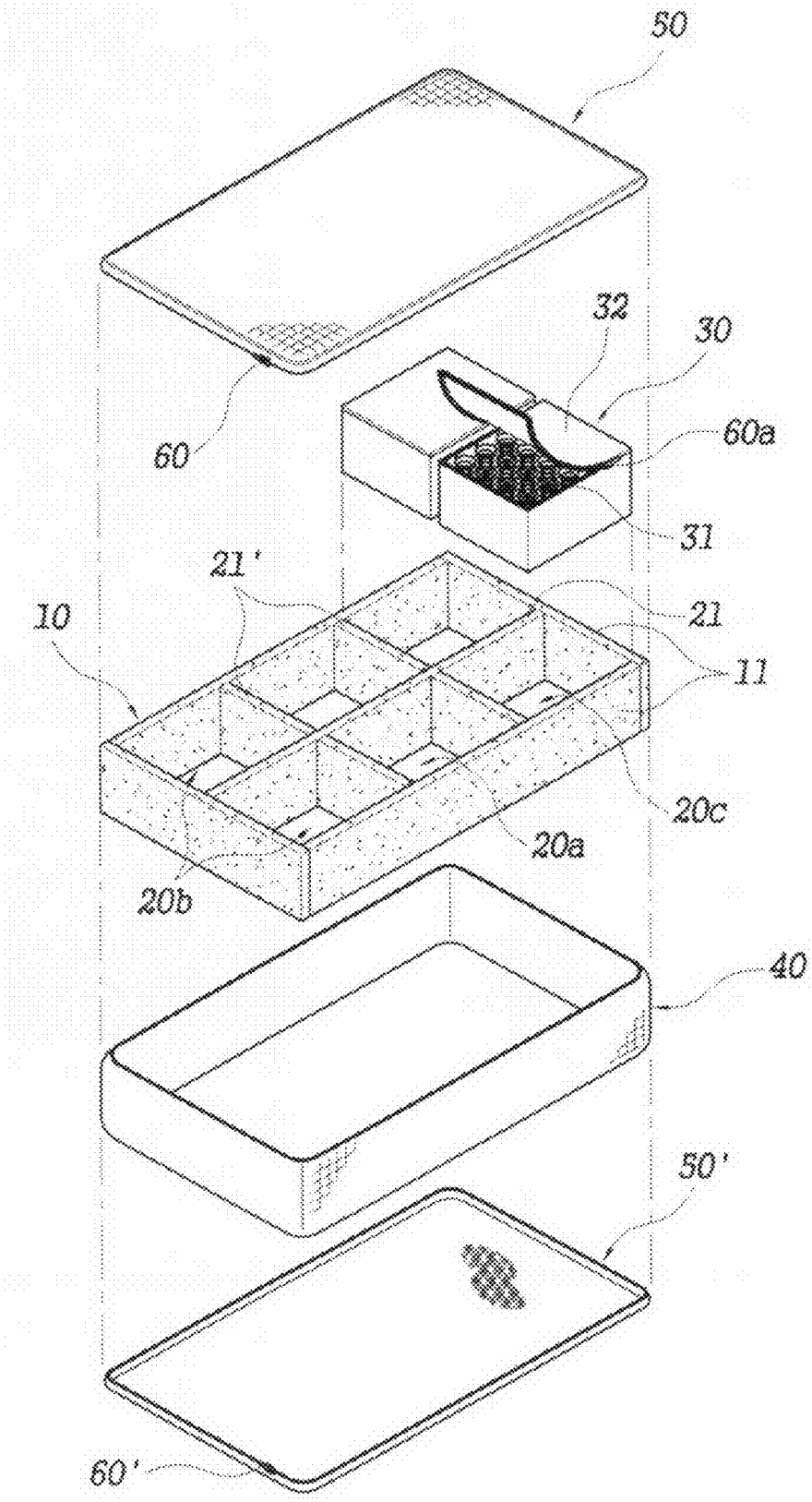

【Figure 12】
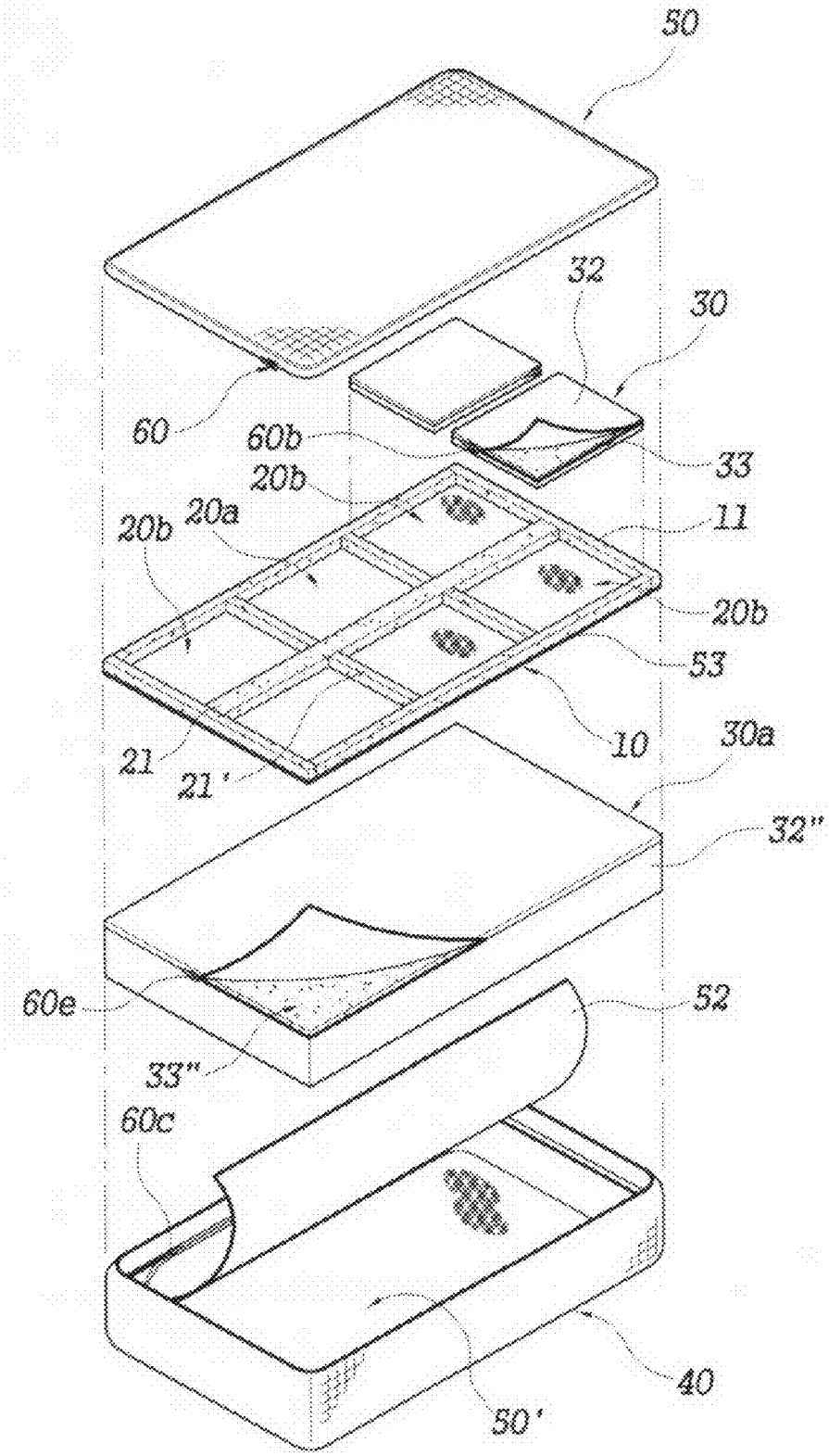

【Figure 13】
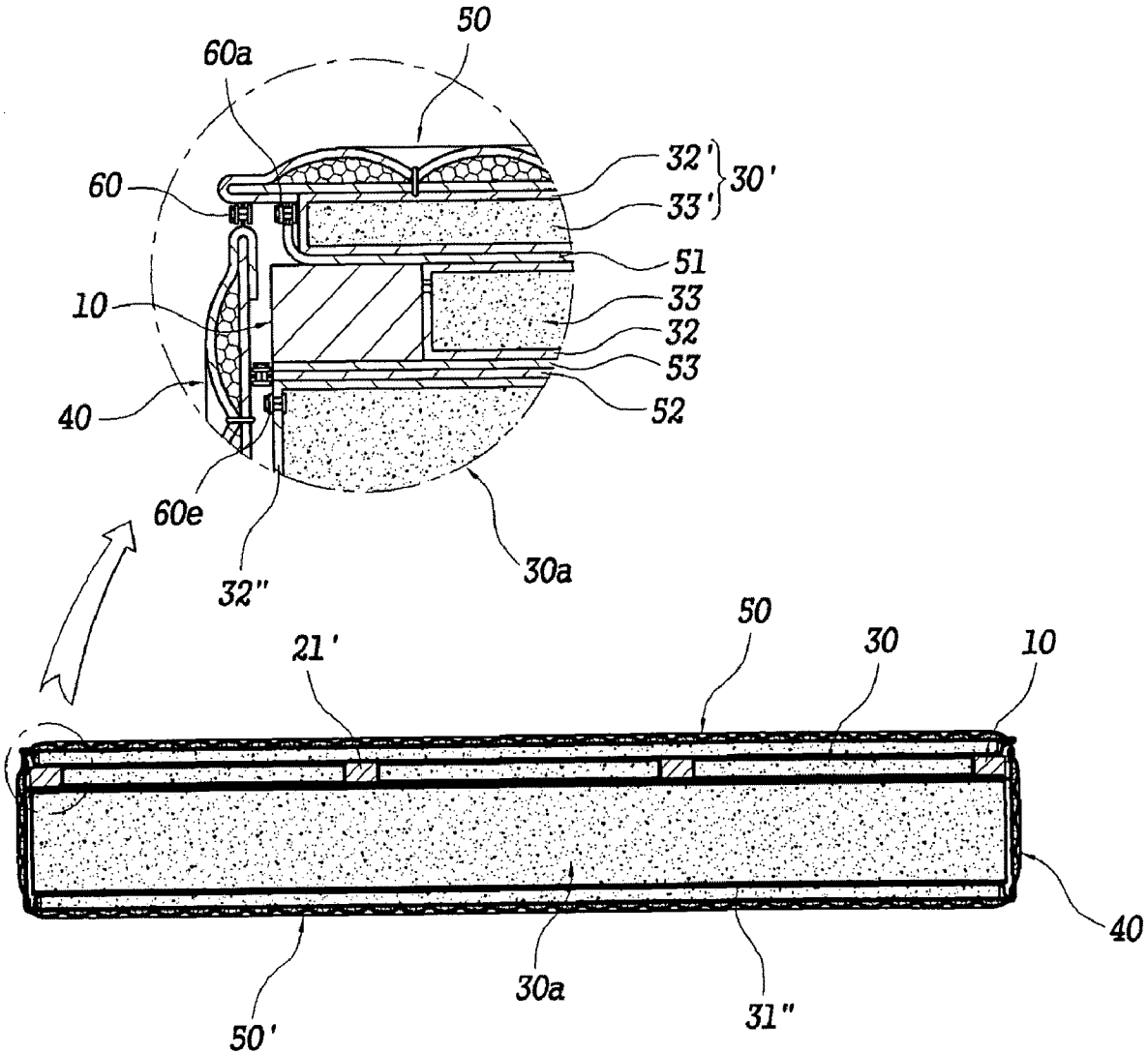

【Figure 14】
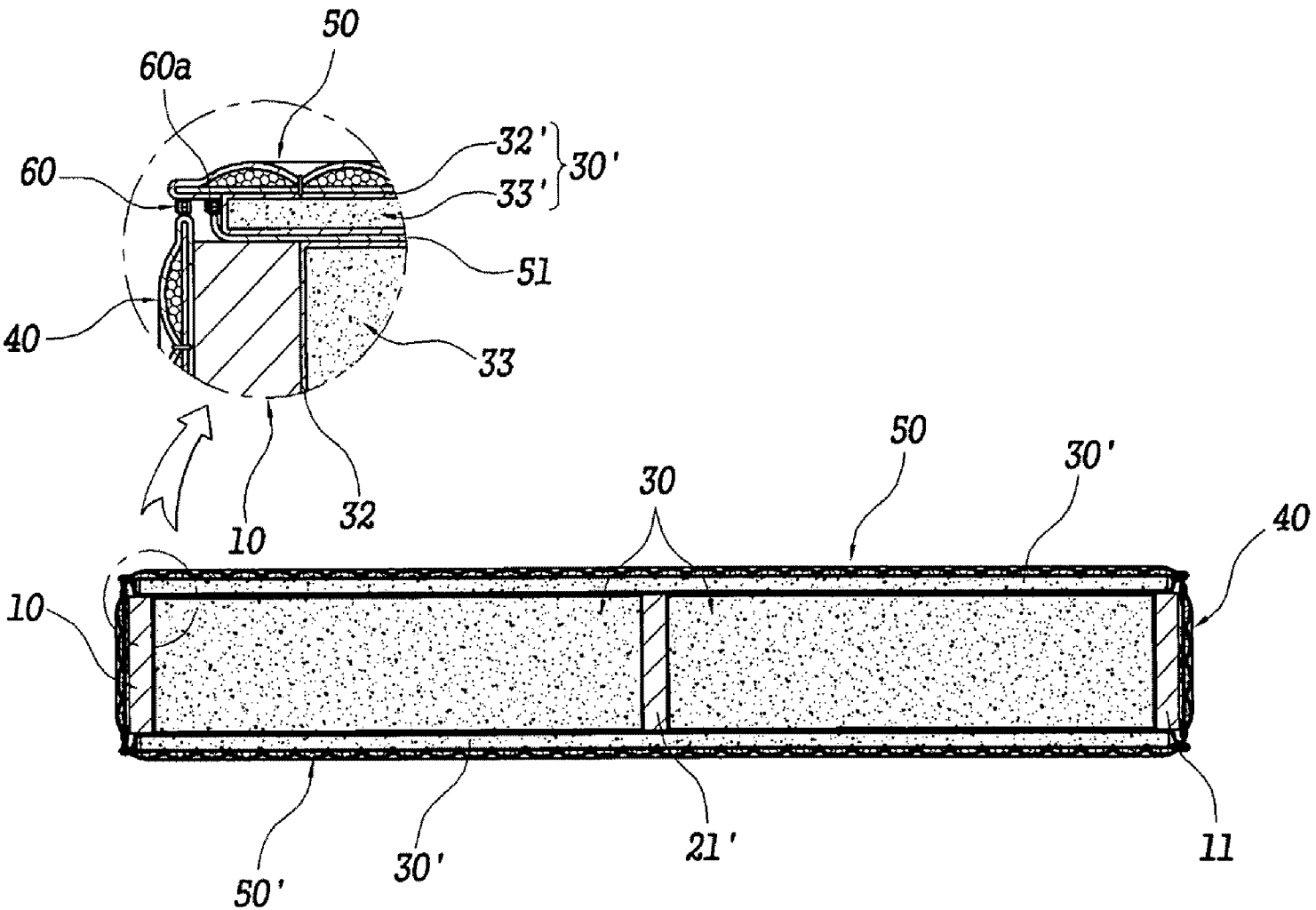

【Figure 15】
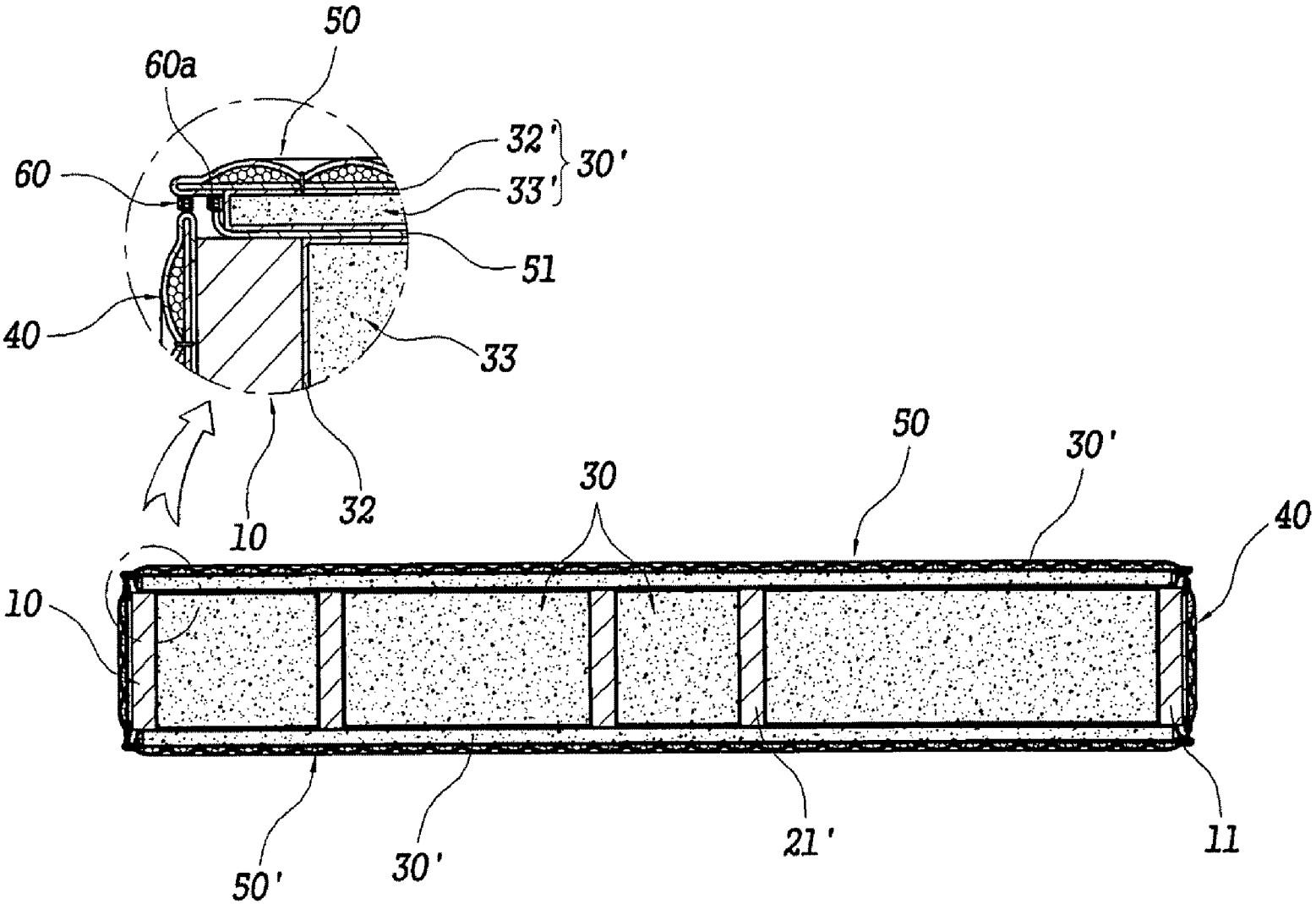

【Figure 16】
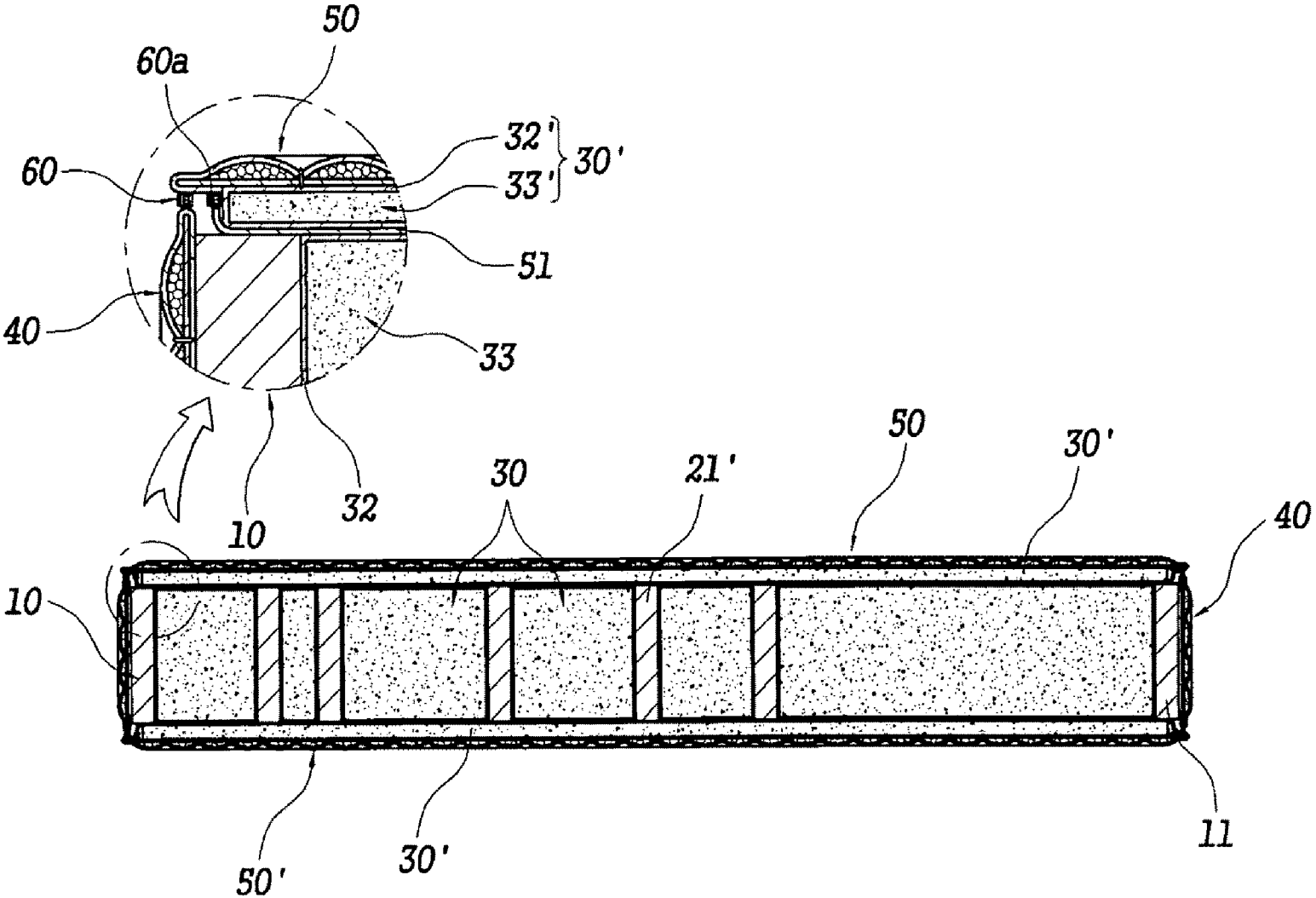

【Figure 17】
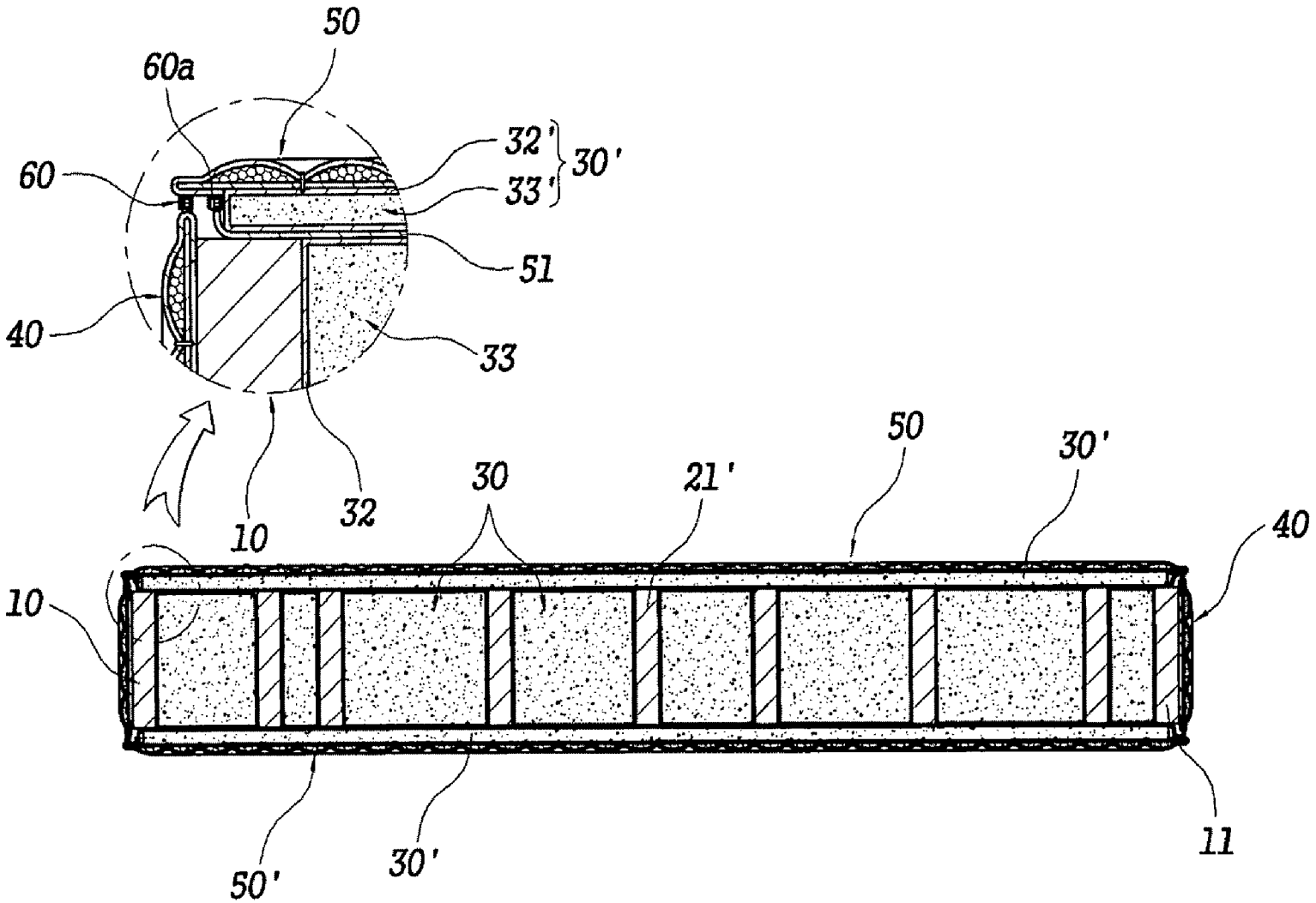

【Figure 18】
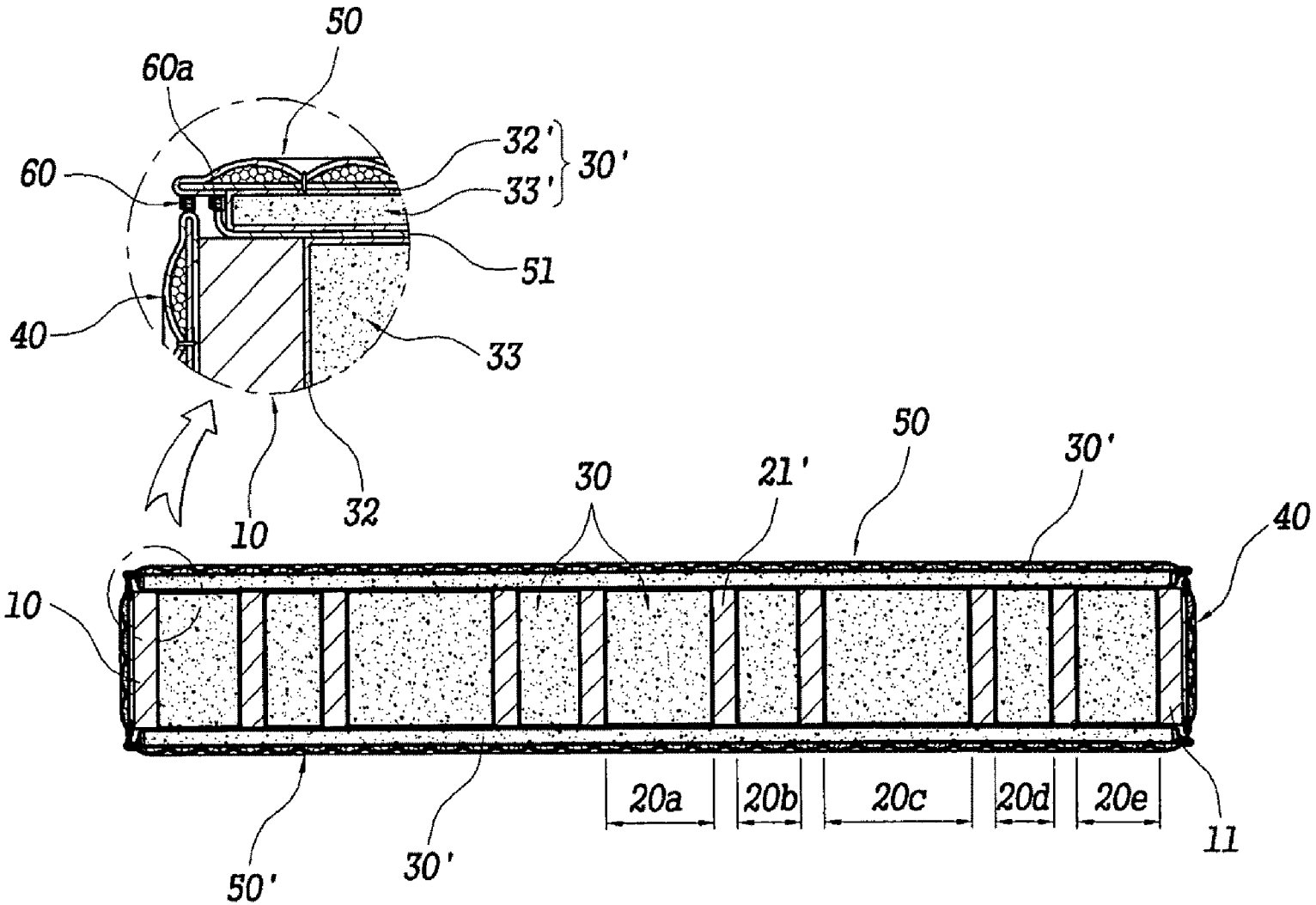

【Figure 19】
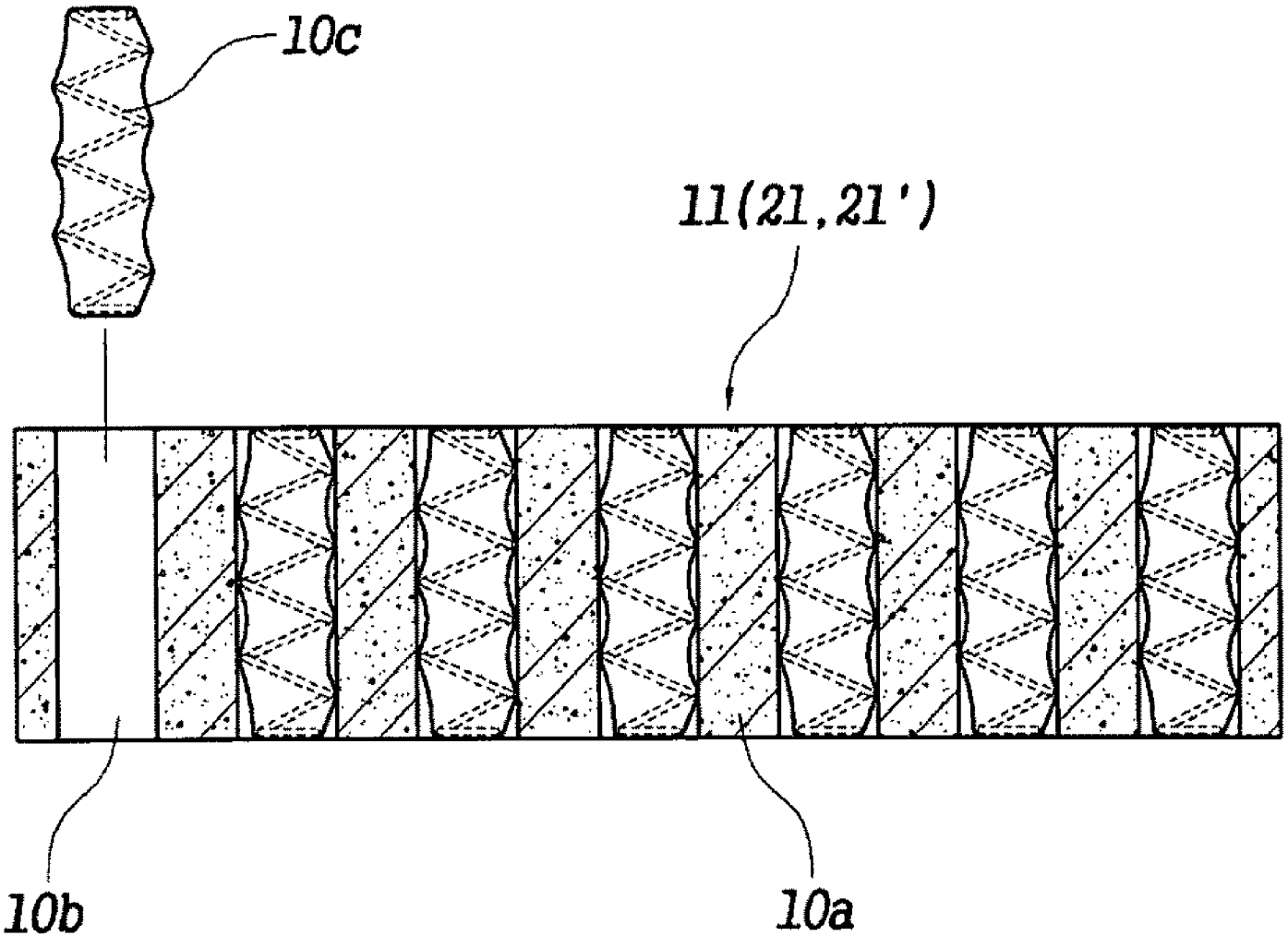

【Figure 20】
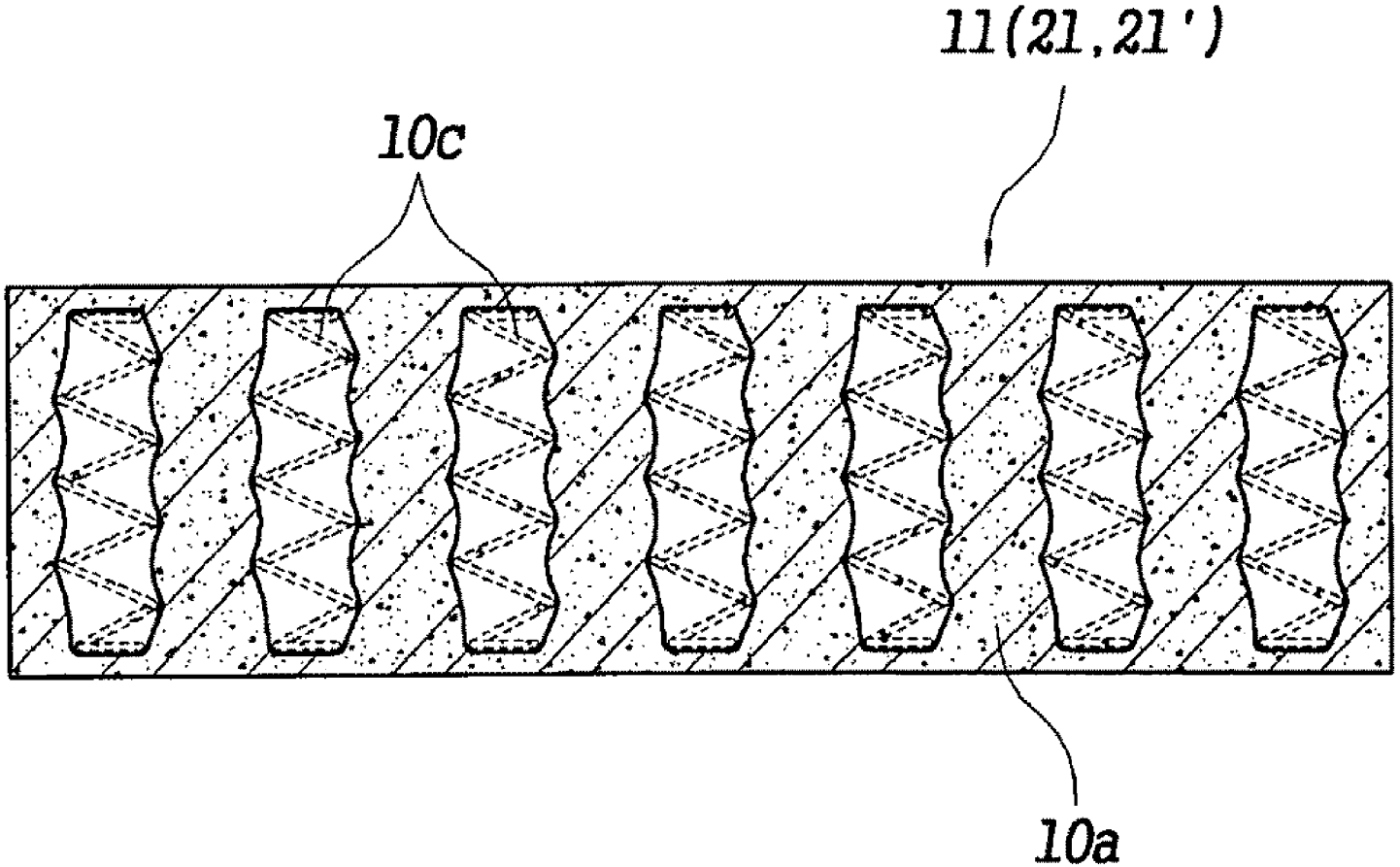

【Figure 21】
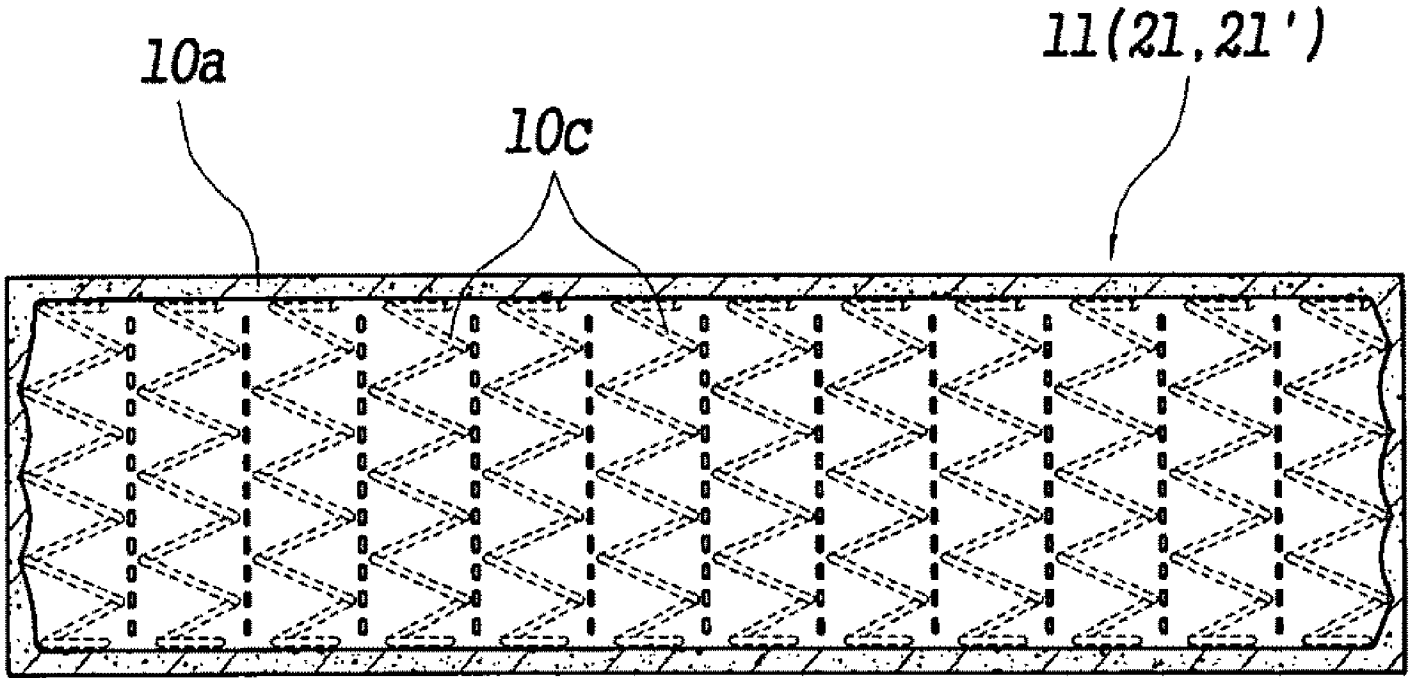

【Figure 22】
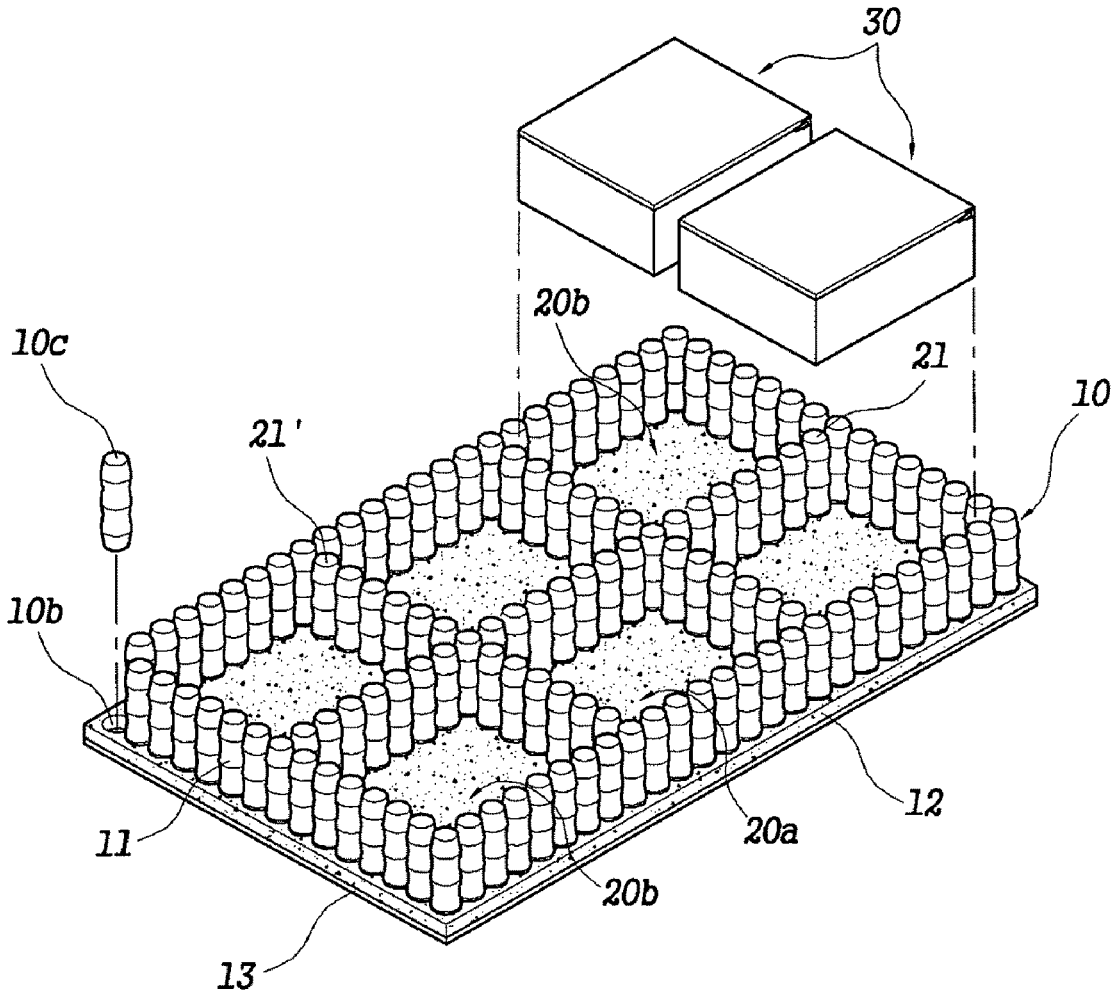

【Figure 23】
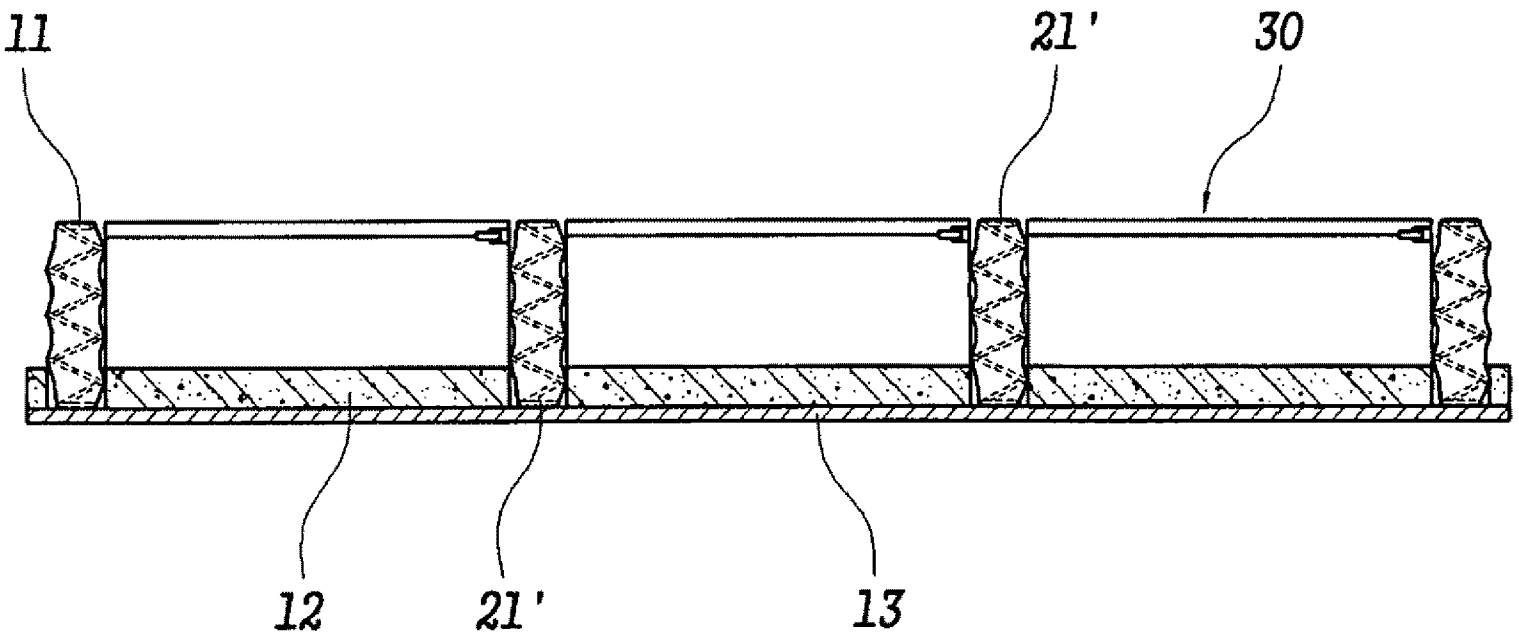

MATTRESS

TECHNICAL FIELD

The present invention relates to a mattress, in particular, to a mattress with a frame including a plurality of cushion elements with different elasticity, which make it possible to selectively employ cushion elements appropriate for the user's respective body parts.

BACKGROUND ART

It is not seldom for the conventional bed mattresses to be discarded as a whole, rather than to be repaired, when the cushion member has lost the elasticity, which varies according to the materials used, the accessories such as side pads and upper/lower cover pads are wholly or partially damaged, soiled or discolored, and so on. That's because all parts of the mattresses, namely the cushion member and the accessories, are integrated into one single body, making it not easy to repair a part or parts of the mattress.

DISCLOSURE

Technical Problem

Further, the conventional mattresses have almost the same elasticity over all the regions or areas thereof and thus, the degrees of compression are different depending on the body parts, heavy or light, when a user lies in the bed, making the mattress or its cushion member compressed under the weights of the users respective body parts, but the curve on the mattress made by the users body weight is not the same as the contour of the users body and thus some body parts, such as the neck and the waist, are not in contact with and supported by the mattress, but are kept apart off the mattress. This results in the user being unable to take or maintain his or her comfortable and relaxing posture lying on the mattress because of tension in the muscles of those parts.

A mattress is disclosed in the Korean Utility Model No. 337232 designed to solve the above described problems, in which the mattress may be longitudinally divided into several portions corresponding to the body parts and having cushions of spring structures with different elasticity therein. The user, however, must change the entire mattress, if damaged, as the integral structure of the mattress makes its partial repair or change of a part or parts difficult or even impossible.

Further, in case of the double bed, it is not sufficient for making a bed mattress comfortable to both of the male and female users, who have different physical sizes and constitutions, to provide the spring structures in different portions of the mattress with the varying elasticity.

Technical Solution

It is an object of the present invention to provide a mattress that allows its user to have a comfortable and relaxing sleep thereon by employing a plurality of cushion elements to be arranged in different portions of the mattress divided corresponding to the user's body parts and have appropriate elasticity for the corresponding part of the user's body in consideration of the age, gender, height, weight and other body constitutions of the user, in order to solve the problems of the conventional mattress as described above.

It is another object of the present invention to provide a mattress having replaceable parts for easy maintenance of the bed and mattress and use for a prolonged period of time.

According to an aspect of the present invention, a mattress comprises:

a mattress frame with an enclosing wall for providing a mounting space therein;

a plurality of cushion elements disposed in the mounting space and forming a mattress body together with the mattress frame;

a side pad covering the periphery of the mattress body; and upper and lower cover pads with outer edges fastened respectively to the top and bottom edges of the side pad to enclose the upper and lower surfaces of the mattress body.

According to another aspect of the invention, the mattress frame comprises a longitudinal division wall for dividing the mounting space into a pair of parallel divisional mounting spaces.

According to still another aspect of the present invention, the mattress further comprises a lower cushion member with the same periphery as the mattress body comprising a mattress frame with or without one or more longitudinal or transverse division walls and a plurality of cushion elements as described above.

Advantageous Effects

Cushion elements of the mattress according to the present invention may be selected to have different elasticity, depending on the regions or areas of the mattress corresponding to the body parts and constitutions and the taste of the user of the bed provided with the mattress.

Further, various parts of the mattress such as cushion elements and side, upper and lower cover pads may be detached for change or repair, leading to extended or prolonged mattress life.

DESCRIPTION OF DRAWINGS

The present invention will be described in detail with reference to the accompanying drawings, in which:

FIG. 1 is an exploded perspective view of a mattress according to a first embodiment of the present invention, FIG. 2 is a side cross-sectional view of a part of the mattress shown in FIG. 1, FIG. 3 is a side cross-sectional view of a combination of an upper cover pad and an auxiliary cushion element of the mattress shown in FIG. 2, FIG. 4 is a side cross-sectional view of another example of the cushion element used in the mattress shown in FIG. 1, FIG. 5 is an exploded perspective view of a mattress according to a second embodiment of the invention, FIG. 6 is a front cross-sectional view of a mattress shown in FIG. 5, FIG. 7 is an exploded perspective view of a mattress according to a third embodiment of the invention, FIG. 8 is a side cross-sectional view of the mattress shown in FIG. 7, FIG. 9 is a side cross-sectional view of a modification of the mattress shown in FIG. 7, FIG. 10 is a side cross-sectional view of another modification of the mattress shown in FIG. 7, FIG. 11 is an exploded perspective view of a mattress according to a fourth embodiment of the invention, FIG. 12 is an exploded perspective view of a mattress according to a fifth embodiment of the invention, FIG. 13 is a side cross-sectional view of the mattress shown in FIG. 12, FIG. 14 is a side cross-sectional view of a mattress with two divisional mounting spaces of the mattress according to a modification of the first embodiment of the present invention, up and down in the longitudinal direction of the mattress, FIG. 15 is a side cross-sectional views of the mattress according to another modification of the first embodiment of the present invention, having four divisional mounting spaces, FIG. 16 is a side cross-sectional view of another modification of the mattress according to the first embodiment of the invention, having six divisional mounting spaces, FIG. 17 is a side cross-sectional view of still another modification of the mattress according to the first embodiment of the invention, having eight divisional mounting spaces, FIG. 18 is a side cross-sectional view of a modification of the mattress according to the third embodiment of the invention, having nine divisional mounting spaces, FIGS. 19 to 21 are partial cross-sectional views of other examples of the enclosing wall and the division wall used in the mattress according to the present invention.

FIG. 22 is a partially exploded perspective view of a mattress body of a modification of the mattress according to the fourth embodiment of the present invention, and FIG. 23 is a partial side cross-sectional view of the mattress body shown in FIG. 22.

MODE FOR INVENTION

FIG. 1 is an exploded perspective view of a mattress according to a first embodiment of the invention, FIG. 2 is a side cross-sectional view of the mattress shown in FIG. 1, FIG. 3 is a side cross-sectional view of a combination of an upper cover pad and an auxiliary cushion element of the mattress shown in FIG. 2, and FIG. 4 is a side cross-sectional view of another example of the cushion element used in the mattress shown in FIG. 1.

The mattress according to first embodiment of the present invention comprises a mattress frame 10 having a rectangular enclosing wall 11 made of elastic urethane foam for providing a mounting space therein, six cushion elements 30 arranged in two rows in the mounting space and forming a mattress body together with the frame 10, a pair of auxiliary cushion elements 30 each comprising a bag 32 and a flat urethane foam 33 and disposed on or beneath the mattress body, a side pad 40 covering the periphery of the mattress body, and upper and lower cover pads 50, 50' respectively covering the auxiliary cushion elements 30 and fastened to the upper and lower ends of the side pad 40 by fasteners 60, 60' provided at the edge thereof.

The cushion element 30 is a spring structure comprising a plurality of coil springs 31 packed in a cubical fabric bag 32 provided with a fastener 60*a*, while the auxiliary cushion elements 30 are respectively combined with and enclosed in the upper or lower cover pad 50, 50' and protective sheets 51 provided with a fastener 60*a* (see FIG. 2). Further, the bag 32 may not be used and the auxiliary cushion element 30 may be disposed only on the mattress body, or may not be employed at all.

The rectangular wall 11 of the frame 10 may be of an integrally formed body or formed with four bar elements by bonding both ends of one to corresponding ends of the other, in which a bonding process is additionally needed and the bonded portions may be easily broken due to possible poor bonding quality or heavy load of long continuance. Therefore, preferably the frame is integrally formed or molded, or provided with thick and/or firm bonded portions. The outer sides of the cushion elements 30 disposed in two rows in the enclosing wall 20 are in close contact with the inner wall surfaces of the wall or the outer sides of the adjacent cushion elements so that they can function as one single cushion elements. Further, as described above, the cushion elements 30 may be made to have different elasticity, if needed, and parts of the auxiliary cushion elements 30 may also be made to have different elasticity.

The cushion elements 30 shown are six in two rows in FIGS. 1 and 2, while the mattress may desirably have four to eighteen cushion members 30 disposed in two rows.

For a double bed, to be used by a male and a female, a husband and a wife, or an adult and a child, one side of the mattress is desirably provided with cushion elements 30 having lower elasticity and/or narrower widths than those disposed at the other side.

In this embodiment, the spring structures are illustrated to use the coil springs 31, but the materials of the cushion elements 30 are not limited thereto and, as shown in FIG. 4, a spring structure may employ pocket springs 31, instead of the coil springs packed in a bag 32 provided with a fastener 60*b*.

Further, similar to the frame, the cushion elements 30 may be formed of elastic sponge, such as urethane foam, and the auxiliary cushion elements 30 may also be formed of the same material as the cushion element, or natural or synthetic rubbers.

FIGS. 5 and 6 are an exploded perspective view and a front cross-sectional view of a mattress according to a second embodiment of the present invention, respectively, in which a longitudinal division wall 21 of the same material as a mattress frame 10 is provided inside the frame 10 to divide a mounting space 20 into two parallel divisional mounting spaces 20.

The mattress shown in FIGS. 5 and 6 may be suitable for a king-sized bed or a double bed. Further, because an outer side of each cushion element 30 is in contact with the division wall 21, which is relatively rigid as compared with the adjacent cushion elements 30, the shape of each cushion element is not easily deformed and thus maintained desirably firm. The division wall 21 may be provided by bonding both ends of an individual element of the same material as the wall of the frame 10 to the inner surfaces of the wall 11, while it is preferable that the division wall is integrally formed with the wall 11.

Further, the number and elasticity of the cushion elements 30 mounted in the two parallel divisional mounting spaces 20 divided by the division wall 21 may be the same as in the first embodiment and will not be described in detail for this embodiment.

FIG. 7 is an exploded perspective view of a mattress according to a third embodiment of the invention, FIG. 8 is a side cross-sectional view of the mattress shown in FIG. 7, and FIGS. 9 and 10 are side cross-sectional views showing modifications of the mattress shown in FIG. 7, in which the mattresses comprise a mattress frame 10 having a wall 11 and a mounting space 20 divided into three, five or seven divisional mounting spaces inside the frame 10 by two, four or six transverse division walls 21, a plurality of cushion elements 30, each of which is disposed in the corresponding divisional mounting spaces, a pair of auxiliary cushion members 30, a side pad 40, and upper and lower cover pads 50, 50'. The mounting space 20 are divided into three, five, or seven divisional mounting spaces 20*a*, 20*b*, 20*c* and 20*d* in the longitudinal direction of the mattress or from the bottom to top thereof, the cushion elements have the same configuration as in the first and second embodiments, and the side pad and the upper and lower cover pads are fastened by a fastener 60, as in the first and second embodiments.

As the number of the divisional mounting spaces of the mounting space 20 increase from three to five, and from five to seven, the lengths of the divisional mounting spaces of the mattress decrease, while the divisional mounting spaces may preferably have different lengths from each other in consideration of the sizes and weights of the body parts of the particular user or an average user and also be provided with cushion elements of different elasticity.

For the mattress shown in FIGS. 7 and 8, it is preferable to make the length of the first and central divisional mounting space 20*a* shorter than the adjacent second divisional mounting spaces 20*b* and dispose in the first divisional mounting space 20*a* a cushion element 30, having elasticity lower than the cushion elements for the second divisional mounting spaces 20*b*.

Further, in case of the mattress shown in FIG. 9 as one of the modifications of the mattress of the third embodiment of the present invention, it has been found suitable for the constitutions of the human body, divided into the hip, trunk, legs, head and feet, to make the length of the first divisional mounting space 20*a* shorter than the adjacent second divisional mounting spaces 20*b* and the lengths of the outermost third divisional mounting spaces 20*c* shorter than the first divisional mounting space 20*a* and dispose in the first divisional mounting space 20*a* a cushion element 30, which has elasticity lower than that for the second divisional mounting spaces 20*b*, and cushion elements 30, having elasticity higher than that for the first divisional mounting space 20*a* and lower than that for second divisional mounting spaces 20*b*, in the third divisional mounting spaces 20*c*.

In case of the mattress shown in FIG. 10, the other modification to the mattress of the third embodiment of the present invention, the first divisional mounting space 20*a* has a length longer than the adjacent second divisional mounting spaces 20*b*, the lengths of the divisional mounting spaces 20*c* at the outer sides of the second divisional mounting spaces 20*b* are longer than the first divisional mounting space 20*a* and the fourth divisional mounting spaces 20*d* at the outer sides of the third divisional mounting spaces 20*c* have lengths longer than the second divisional mounting spaces 20*b*, while the elasticity of the cushion element 30 disposed in the first divisional mounting space 20*a* is lower than the cushion elements 30 in the second divisional mounting spaces 20*b*, the elasticity of the cushion elements 30 in the third divisional mounting spaces 20*c* is higher than that in the first divisional mounting space 20*a* and lower than that in the second divisional mounting spaces 20*b*, and the cushion elements in the fourth divisional mounting spaces 20*d* have the elasticity higher than that in the first and third divisional mounting spaces 20*a* and 20*c* and lower than that in the second divisional mounting spaces 20*b*.

The above configurations are for allowing the user to have a calm and comfortable sleep with the neck, waist and crooks of the knees and arms, which are less heavy, narrower or slimmer than other body parts, being appropriately in contact with and supported by the corresponding cushion elements as are other body parts such as the head, trunk, hip, legs and feet, because other mattresses having a mattress element with the uniform elasticity may not be pressed down to make its surface take the shape or profile of the users body and thus it is not possible for the relatively lighter, narrower or slimmer body parts like the waist, neck and the crooks of the knees and arms to lie at the full length comfortably on the mattress.

By making the elasticity of the mattress elements different as described above, the cushion elements 30 in the divisional mounting spaces 20*a*, 20*b*, 20*c* and 20*d* are differently pressed down, depending on the corresponding parts of the human body when a user lies on the mattress. In other words, a cushion element in the first divisional mounting space 20*a* for the hip is pressed down to the highest degree and ones in the second divisional mounting space 20*b* at the top portion for the waist to the least, while one in the third divisional mounting space 20*c* at the top portion of the mattress for the trunk less than one in the first divisional mounting space 20*a* and more than one in the fourth divisional mounting space 20*d* at the top portion of the mattress for the head and ones in the rest of the second to fourth divisional mounting space 20*b*, 20*c* and 20*d* at the bottom portion of the mattress for legs and feet to the degree relative to the weight of each part of the legs and feet.

As described above, by disposing the cushion elements having different elasticity that are roughly in inverse proportion to the weight of the corresponding part of the human body, the mattress, actually the cushion elements, is pressed down, taking the profile or shape of the human body, and supports all the body parts comfortably. The same elasticity and length of each pair of the cushion element in the divisional mounting spaces 20*b*, 20*c* and 20*d*, sequentially outwardly provided from the first divisional mounting space 20*a*, allow the user to use the mattress with the top and the bottom reversed, if necessary.

Referring to FIG. 11 showing an exploded perspective view of a mattress according to a fourth embodiment of the present invention, shown is a mattress comprising a mattress frame 10 having six divisional mounting spaces 20*a*, 20*b* and 20*c*, in the mounting space 20 partitioned by a longitudinal division wall 21 and two transverse division walls. Cushion elements 30 are made by arranging coil springs 31 in a fabric bag 32.

The mattress shown in FIG. 11 may be suitable for particularly a king-sized or double bed for simultaneous use by two persons with different body constitutions of man and woman, such as height or weight, as a pair of cushion elements 30 having different elasticity may be used in each pair of the right and left divisional mounting spaces 20*a*, 20*b* or 20*c*.

In addition, the lengths of one or more pairs of the divisional mounting spaces 20*a*, 20*b* and 20*c* may be made different for two users of considerably different body constitutions.

FIG. 12 is an exploded perspective view of a mattress according to a fifth embodiment of the present invention and FIG. 13 is a side cross-sectional view of the mattress shown in FIG. 12.

Referring to FIGS. 12 and 13, the mattress comprises: a mattress frame 10 which comprises a rectangular wall 11 formed by four bar-shaped urethane foam elements with both ends thereof being bonded to corresponding ends of other urethane foam elements, divisional mounting spaces 20*a* and 20*b* divided by a longitudinal and four transverse division walls 21 and 21' of bar-shaped urethane foam element with both ends thereof bonded either to the inner surface of the wall 11 or to the side surface of the longitudinal division wall 21, and a bottom cover 53 for closing up the lower opening of the frame 10 therewith; six cushion elements 30 disposed in each of the six divisional mounting spaces 20*a* and 20*b* for forming a mattress body with the frame 10; a lower cushion member 30*a* disposed under the frame 10; a side pad 40 covering the periphery of the structure formed by combining the lower cushion member 30*a* with the mattress body; an upper cover pad 50 covering the mattress body and provided with a fastener 60 for fastening the edge of the upper cover pad 50 to the upper edge of the side pad 40, and a lower cover pad 50' sewn along the lower edge of the side pad 40 and receiving the mattress body and the lower cushion member 30*a* together with the side pad 40.

The lower cushion member 30*a* is desirably thicker than that of the mattress body comprising the frame 10 and the cushion elements 30, or both of them may have the same thickness.

The cushion elements 30 and the lower cushion member 30*a* are respectively formed by enclosing a resilient urethane foam 33 or 33" in fabric bags 32 or 32" provided with a zipper 60*b* or 60*e*, whereas the spring structures described above may also be used alternatively.

A separation sheet 52 is disposed between the frame 10 and the lower cushion member 30*a* and may be opened or closed by a fastener 60*c* provided at the outer edge thereof and the inner surface of the side pad 40. Because the outer edge of the lower cover pad 50' is sewn around the lower edge of the side pad 40, it is possible to put the lower cushion member 30*a* into/out of the space formed by the side pad and the lower cover pad.

The bottom sheet 53 is provided to prevent the cushion elements 30 in the divisional mounting spaces 20*a* and 20*b* from dropping out, but is not an essential component of the frame or the mattress.

It is preferable that the lower cushion member 30*a* has elasticity stronger than the cushion elements 30 of the strongest elasticity and also to make the elasticity of each of the cushion elements different for the divisional mounting spaces 20*a* and 20*b*, as described in respect to the mattress according to the first embodiment of the present invention. Further, as described in respect to the mattress according to the fourth embodiment of the present invention, the widths of the divisional mounting spaces 20*a* and 20*b* and the elasticity of the cushion elements 30 are desirably different according to the locations of the divisional mounting spaces, that is the left or the right.

Further, the lower cover pad may be fastened to the side pad by a fastener as in the preceding embodiments of the present invention.

FIGS. 14 to 17 are side cross-sectional views of mattresses according to the modifications of the first embodiment of the present invention, in which a mounting space 20 is divided into even number of the divisional mounting spaces, i.e. two, four, six or eight. Each of the divisional mounting spaces of the mattresses shown in the drawings are provided to have lengths adapted to the size of the corresponding body parts of the user, and the configuration and function of each of the component may be the same as in the first to third embodiments and thus will not be described in detail.

Lengths of the divisional mounting spaces of the mattresses may be set to be different from FIGS. 14 to 17, while those mattresses may be used by turning them face down, instead of turning the top and bottom portions as the mattresses described in respect to the second to fourth embodiments.

FIG. 18 is a side cross-sectional view of a mattress with a mounting space divided into nine divisional mounting spaces according to a modification of the third embodiment of the present invention, which may be suitable for a very tall person or user. The mattress has a first mounting space 20*a* at the center and second to fifth divisional mounting space 20*b*~20*e* sequentially formed upwardly from the first divisional mounting space 20*a*. The lengths of the divisional mounting spaces are set in consideration of the sizes of the corresponding body parts of the user, i.e. the hip, waist, trunk, neck, and head, while the divisional mounting spaces 20*b* to 20*e* at the bottom portion of the mattress may have the same lengths as the corresponding divisional mounting spaces at the top portion thereof. The wall 11 of the frame 10 of the mattress according to the above embodiments of the present invention should be made to have the same as or lower elasticity than conventional mattresses and sufficient strength to retain its original shape and elasticity over the mattress life as well, while it is preferable for the division walls 21 and 21' to have elasticity the same as or lower than a cushion element 30 having least elasticity among the cushion elements so that all the cushion elements may be pressed down by the body parts of the user without being obstructed by the division walls 21 and 21'. However, the division walls should also have sufficient strength which should be retained over the mattress life, as described for the wall 11.

Alternatively, the frame 10 may be made by placing pocket springs 10*c* in vertical holes 10*b* formed at regular intervals in a urethane foam wall member 10*a* as shown in FIG. 19, by embedding pocket springs in a urethane foam wall element 10*a* as shown in FIG. 20, or by embedding an assembly of pocket springs arranged in a row in a urethane foam wall element 10*a* as shown in FIG. 21, while it may be possible to use common coil springs instead of the pocket springs.

Further, various kinds of sponge materials other than urethane foam may be used for making cushion elements, as far as they have appropriate elasticity.

FIGS. 22 and 23 are a partial exploded perspective view and a partial side cross-sectional view of a mattress body of a modification of the mattress according to the fourth embodiment of the present invention (see FIG. 11), which comprises a mattress frame 10 and cushion elements 30. The frame 10 comprises an elastic base plate 12 which is formed of urethane foam and has a plurality of sequential holes 10*b*, pocket springs 10*c* with the lower portion thereof fixed in one of the holes 10*b*, a wall 11 and division walls 21 and 21' which define a first and a second divisional mounting spaces 20*a* and 20*b*, and a plastic bottom plate 13 attached to the bottom of the base plate 12. Further, the cushion elements 30 are placed in the divisional mounting spaces 20*a* and 20*b*.

Referring to FIGS. 22 and 23, the pocket springs 10*c* are fixed in the holes 10*b*, not protruding downwardly from the base plate 12, because the holes 10*b* are closed by the bottom plate 13, while it may be possible to form holes 10*b* with the bottoms closed, for example, by using a thick base plate 12.

Further, it is preferable to have the middle and/or upper portions of the pocket springs 10*c* coupled to the adjacent pocket springs 10*c* so that the frame may have strength enough to prevent the wall and the division walls from being swayed when the cushion elements 30 of the mattress are pressed down by the weight of the user.

Further, requirements for the elasticity and the strength of the wall and division walls described above for other embodiments apply to the mattress of the FIGS. 22 and 23.

The division walls 21 and 21' of the frame 10 may have the same height as the wall 11 as illustrated for the above embodiments, but also a height slightly lower than the wall 11, for example, a half or more than that of the wall 11, with the elasticity lower than the wall 11.

In addition to making the cushion elements 30 have the same height but different elasticity as described above, one cushion element or a combination of two or more adjacent cushion elements may have the edges of the same or about the same height and a round center portion with a gradually protruding or receding surface. Further, a divisional mounting space may have a plurality of cushion elements disposed therein.

Although the preferred embodiments of the present invention have been disclosed for illustrative purposes, those skilled in the art will appreciate that various modifications, additions and substitutions are possible, without departing from the scope and spirit of the present invention. Further, the present invention is not limited to the disclosed exemplary embodiments and the description in the above, but shall be restricted by the accompanying claims only.

The invention claimed is:

1. A mattress comprising:

a mattress frame with an enclosing wall with transverse division walls made of elastic material for forming three divisional mounting spaces of a first and central divisional mounting space and a pair of second divisional mounting spaces, provided outwardly of said first and central divisional mounting space;

one or more cushion elements disposed in each of said divisional mounting spaces and forming a mattress body together with said mattress frame;

a side pad covering the periphery of the mattress body; and upper and lower cover pads with outer edges fastened respectively to the top and bottom edges of said side pad to enclose the upper and lower surfaces of the mattress body, wherein said cushion elements in both of said second divisional mounting spaces have the same elasticity which is higher than that of the cushion element in said first and central divisional mounting space and the length of said first divisional mounting space is shorter than that of said pair of second divisional mounting spaces, said pair of second divisional mounting spaces having the same length.

2. The mattress as claimed in claim 1, further comprising:

a lower cushion member having the same size of the periphery as the mattress body, disposed under said mattress body and covered by said side pad together with the mattress body.

3. The mattress as claimed in claim 1, wherein said enclosing wall and/or said division wall or walls are integrally made of elastic sponge material or materials.

4. The mattress as claimed in claim 1, wherein said enclosing wall and/or said division wall or walls are made of bar elements of elastic sponge material with the opposite ends thereof bonded to the corresponding opposite ends of bar elements adjacent thereto.

5. The mattress as claimed in claim 1, wherein said enclosing wall and/or said division wall or walls comprise a multiplicity of spring structures with the bottom portion thereof fixed in corresponding mounting hole provided on a frame base.

6. The mattress as claimed in claim 1, wherein said enclosing wall and/or said division wall or walls comprise a frame member of elastic sponge material and a multiplicity of spring structures embedded in the frame member.

7. The mattress as claim in claim 2, wherein said lower cushion member comprises a frame with or without one or more longitudinal or transverse division walls and a plurality of cushion elements enclosed in said frame.

8. The mattress as claimed in claim 5, wherein said mattress frame further comprises a closing plate attached to the bottom of said frame.

9. The mattress as claimed in claim 5, wherein said spring structures are joined to the adjacent spring structures at the middle or upper parts thereof.

10. The mattress as claimed in claim 1, wherein said cushion elements are made of elastic sponge material or a cylindrical spring structure or spring structures using coil springs or pocket springs.

11. The mattress as claimed in claim 10, wherein said cushion elements are packed in a fabric bag.

12. The mattress as claimed in claim 1, further comprising a pair of third divisional mounting spaces outside each of said second divisional mounting spaces, wherein cushion elements in said third divisional mounting spaces have the same elasticity and the elasticity of cushion elements in said third divisional mounting spaces is different from cushion elements in said first and second divisional mounting spaces.

13. The mattress as claimed in claim 12, wherein the elasticity of cushion elements in said third divisional mounting spaces is lower than cushion elements in said second divisional mounting spaces and higher than cushion elements in said first divisional mounting space.

14. The mattress as claimed in claim 12, wherein the length of said first divisional mounting space is shorter than that of said second divisional mounting spaces and longer than that of said third divisional mounting spaces, which have the same length.

15. The mattress as claimed in claim 12, further comprising a pair of fourth divisional mounting spaces outside each of said third divisional mounting spaces, wherein cushion elements in said fourth divisional mounting spaces have the same elasticity.

16. The mattress as claimed in claim 15, wherein the length of said third divisional mounting spaces is shorter than that of said first divisional mounting space and said fourth divisional mounting spaces have a length shorter than that of said second divisional mounting spaces.

17. The mattress as claimed in claim 15, wherein the elasticity of the cushion element in said first divisional mounting space is lower than that for said second divisional mounting spaces, the elasticity of the cushion elements for said third divisional mounting spaces is higher than that for said first divisional mounting space and lower than that for said second divisional mounting spaces and the elasticity of cushion members in said fourth divisional mounting spaces is higher than cushion elements in said first and third divisional mounting spaces and lower than cushion elements in said second divisional mounting spaces.

18. The mattress as claimed in claim 15, further comprising a pair of fifth divisional mounting spaces outside each of said fourth divisional mounting spaces, wherein cushion elements in the fifth divisional mounting spaces have the same elasticity.

19. The mattress as claimed in claim 18, wherein the length of said third divisional mounting spaces is the same as that of said fifth divisional mounting spaces.

20. The mattress as claimed in claim 18, wherein the elasticity of the cushion element in said first divisional mounting space is lower than that for said second divisional mounting spaces, the elasticity of the cushion elements for said third divisional mounting spaces is higher than that for said first divisional mounting space and lower than that for said second divisional mounting spaces, the elasticity of cushion members in said fourth divisional mounting spaces is higher than cushion elements in said first and third divisional mounting spaces and lower than cushion members in said second divisional mounting spaces and the elasticity of cushion members in said fifth divisional mounting spaces is higher than cushion elements in said first and third divisional mounting spaces and lower than cushion members in said second and fourth divisional mounting spaces.

21. The mattress as claimed in claim 1, wherein said cushion elements are disposed in left and right rows in each of said divisional mounting spaces and two adjacent cushion elements in the left and right rows have elasticity different from each other.

22. The mattress as claimed in claim 1, further comprising one or two auxiliary cushion elements made of elastic sponge material or a spring structure comprising coil springs or pocket springs and disposed on and/or under the mattress body.

23. The mattress as claimed in claim 2, wherein said lower cushion member is formed of elastic sponge material or a spring structure made of coil springs or pocket springs.

24. The mattress as claimed in claim 2, further comprising a separation sheet disposed between the mattress body and said lower cushion member.

25. The mattress as claimed in claim 2, wherein said mattress frame comprises a closing sheet attached thereunder.

26. The mattress as claimed in claim 2, wherein said lower cushion member has a higher elasticity than the mattress body.

27. The mattress as claimed in claim 1, wherein a fastener is provided to separably couple said side pad and said upper cover pad together.

28. The mattress as claimed in claim 2, wherein a fastener is provided to separably couple said side pad and said lower cover pad together.

* * * * *